US010767452B2

(12) United States Patent
Arsalan et al.

(10) Patent No.: US 10,767,452 B2
(45) Date of Patent: Sep. 8, 2020

(54) LINER INSTALLATION WITH INFLATABLE PACKER

(71) Applicants: Saudi Arabian Oil Company, Dhahran (SA); WIRELESS INSTRUMENTATION SYSTEMS AS, Trondheim (NO)

(72) Inventors: Muhammad Arsalan, Dhahran (SA); Henrik Wanvik Clayborough, Trondheim (NO); Jarl André Fellinghaug, Trondheim (NO); Brett W. Bouldin, Dhahran (SA)

(73) Assignees: Saudi Arabian Oil Company, Dhahran (SA); WIRELESS INSTRUMENTATION SYSTEMS AS, Trondheim (NO)

( * ) Notice: Subject to any disclaimer, the term of this patent is extended or adjusted under 35 U.S.C. 154(b) by 83 days.

(21) Appl. No.: 16/001,634

(22) Filed: Jun. 6, 2018

(65) Prior Publication Data

US 2019/0376370 A1 Dec. 12, 2019

(51) Int. Cl.

| | |
|---|---|
| ***E21B 43/10*** | (2006.01) |
| ***E21B 33/127*** | (2006.01) |
| ***E21B 23/06*** | (2006.01) |

(52) U.S. Cl.

CPC ..... *E21B 43/108* (2013.01); *E21B 33/127* (2013.01)

(58) Field of Classification Search

CPC ..... E21B 43/103; E21B 43/108; E21B 43/10; E21B 23/06; E21B 33/127

See application file for complete search history.

(56) References Cited

U.S. PATENT DOCUMENTS

| | | | | |
|---|---|---|---|---|
| 2,643,723 A * | 6/1953 | Lynes | ..... | E21B 33/1294 166/152 |
| 3,175,618 A | 3/1965 | Lang et al. | | |
| 3,918,520 A * | 11/1975 | Hutchison | ..... | E21B 33/127 166/64 |
| 5,375,622 A | 12/1994 | Houston | | |

(Continued)

FOREIGN PATENT DOCUMENTS

| | | |
|---|---|---|
| CN | 201496028 | 6/2010 |
| JP | 2010156172 | 7/2010 |
| WO | WO 2017146593 | 8/2017 |

OTHER PUBLICATIONS

International Search Report and Written Opinion issued in International Application No. PCT/US2019/032943 dated Aug. 14, 2019, 13 pages.

(Continued)

*Primary Examiner* — Catherine Loikith

(74) *Attorney, Agent, or Firm* — Fish & Richardson P.C.

(57) ABSTRACT

A well tool includes a deformable liner configured to be positioned within a wellbore. The deformable liner is configured to be deformed radially. The well tool includes a first inflatable packer configured to be positioned within the deformable liner. The first inflatable packer is configured to be inflated while positioned within the deformable liner to deform the deformable liner radially. The well tool includes a second inflatable packer configured to be positioned around the deformable liner. The second inflatable packer is configured to be inflated to an inner wall of the wellbore.

16 Claims, 16 Drawing Sheets

(56) References Cited

U.S. PATENT DOCUMENTS

| | | | | |
|---|---|---|---|---|
| 5,613,555 | A | 3/1997 | Sorem et al. | |
| 6,044,906 | A | 4/2000 | Saltel | |
| 6,578,638 | B2 | 6/2003 | Guillory et al. | |
| 6,779,601 | B2 * | 8/2004 | Wilson | E21B 33/1208 166/187 |
| 9,784,077 | B2 * | 10/2017 | Gorrara | E21B 43/103 |
| 10,115,942 | B2 | 10/2018 | Qiao et al. | |
| 2007/0012437 | A1 | 1/2007 | Clingman et al. | |
| 2012/0018143 | A1 | 1/2012 | Lembcke | |
| 2013/0068481 | A1 | 3/2013 | Zhou | |
| 2016/0177659 | A1 | 6/2016 | Voll et al. | |
| 2019/0049054 | A1 | 2/2019 | Gunnarsson | |
| 2019/0376371 | A1 * | 12/2019 | Arsalan | E21B 43/108 |

OTHER PUBLICATIONS

International Search Report and Written Opinion issued in International Application No. PCT/US2019/032953 dated Aug. 14, 2019, 13 pages.

Cox et al., "Realistic Assessment of Proppant Pack Conductivity for Material Section," SPE-84306-MS, presented at the Annual Technical Conference, Oct. 5-8, 2003, Society of Petroleum Engineers, 12 pages.

Gillard et al., "A New Approach to Generating Fracture Conductivity," SPE-135034-MS, presented at the SPE Annual Technical Conference and Exhibition, Sep. 19-22, 2010, Society of Petroleum Engineers 14 pages.

Gomaa et al., "Computational Fluid Dynamics Applied to Investigate Development and Optimization of Highly Conductive Channels within the Fracture Geometry," SPE-179143-MS, Society of Petroleum Engineers, SPE Production & Operations, 32, Nov. 4, 2017, 12 pages.

Gomaa et al., "Improving Fracture Conductivity by Developing and Optimizing a Channels Within the Fracture Geometry: CFD Study," SPE-178982-MS, Society of Petroleum Engineers, SPE International Conference and Exhibition on Formation Damage Control, Feb. 24-26, 2016, 25 pages.

Kern et al., "Propping Fractures With Aluminum Particles," SPE-1573-G-PA, Journal of Per. Technology, vol. 13, No. 6, Jun. 1961, pp. 583-589, 7 pages.

Meyer et al., "Theoretical Foundation and Design Formulae for Channel and Pillar Type Propped Fractures—A Method to Increase Fracture Conductivity," SPE-170781-MS, Society of Petroleum Engineers, SPE Annual Technical Conference and Exhibition, Oct. 27-29, 2014, 25 pages.

Palisch et al., "Determining Realistic Fracture Conductivity and Understanding its Impact on Well Performance—Theory and Field Examples," SPE-106301-MS, Society of Petroleum Engineers, SPE Hydraulic Fracturing Technology Conference, Jan. 29-31, 2007, 13 pages.

Poollen et al., "Hydraulic Fracturing—FractureFlow Capacity vs Well Producity," SPE-890-G, presented at 32nd Annual Fall Meeting of Society of Petroleum Engineers, Oct. 6-9, 1957, published as Petroleum Transactions AIME vol. 213, 1958, 5 pages.

Tinsley and Williams, "A new method for providing increased fracture conductivity and improving stimulation results," SPE-4676-PA, Journal of Petroleum Technology, vol. 27, No. 11, Nov. 1975, 7 pages.

Vincent, "Examining Our Assumptions—Have Oversimplifications Jeopardizedour Ability to Design Optimal Fracture Treatments," SPE-119143-MS, presented at the SPE Hydraulic Fracturing Technology Conference, Jan. 19-21, 2009, 51 pages.

Vincent, "Five Things You Didn't Want to Know about Hydraulic Fractures," ISRM-ICHF-2013-045, presented at the International Conference for Effective and Sustainable Hydraulic Fracturing: An ISRM specialized Conference, May 20-22, 2013, 14 pages.

Walker et al., "Proppants, We Still Don't Need No Proppants—A Perspective of Several Operators," SPE-38611-MS, presented at the SPE Annual Technical Conference and Exhibition, Sep. 27-30, 1995, 8 pages.

Williams, "A new method for providing increased fracture conductivity and improving stimulation results," SPE-4676-PA, Journal of Petroleum Technology, vol. 27, No. 11, 1975, (1319-1325).

Poollen, "Productivity vs Permeability Damage in Hydraulically Produced Fractures," Paper 906-2-G, American Petroleum Institute, presented at Drilling and Production Practice, Jan. 1, 1957, 8 pages.

* cited by examiner

LINER INSTALLATION WITH INFLATABLE PACKER

TECHNICAL FIELD

This disclosure relates to using inflatable packers within a wellbore.

BACKGROUND

An inflatable packer is a type of packer that uses an inflatable bladder to expand the packer element against a casing or wellbore. A drop ball or a series of tubing movements are sometimes necessary to prepare for setting the inflatable packer. Inflatable packers can be inflated using hydraulic pressure provided, for example, by applying pump pressure. Inflatable packers are capable of relatively large expansion ratios, which can be useful in through-tubing work where the tubing size or completion components can impose a size restriction on devices designed to set in the casing or liner below the tubing.

SUMMARY

This disclosure describes technologies relating to using inflatable packers within a wellbore, for example, to install a liner.

Certain aspects of the subject matter described here can be implemented as a method. A well tool is positioned within a wellbore. The well tool has an initial outer diameter before the well tool is positioned within the wellbore. The well tool includes a deformable liner, a first inflatable packer positioned within the deformable liner, and a second inflatable packer positioned around the deformable liner. The first inflatable packer is inflated to deform the deformable liner, such that an inner liner diameter of the deformable liner, after the deformable liner is deformed, is equal to or greater than the initial outer diameter of the well tool. The second inflatable packer is inflated to sealably contact an inner wall of the wellbore.

This, and other aspects, can include one or more of the following features.

After inflating the first inflatable packer, the first inflatable packer can be removed from within the deformable liner.

Inflating the second inflatable packer can include flowing a hardening fluid into the second inflatable packer. Inflating the second inflatable packer can include allowing the hardening fluid to solidify within the second inflatable packer, such that the second inflatable packer remains permanently inflated.

The well tool can include an inflation tool coupled to each of the first inflatable packer and the second inflatable packer, independently. The inflation tool can be configured to convey hydraulic pressure to inflate each of the first inflatable packer and the second inflatable packer, independently.

The well tool can include a tubular connection connecting the inflation tool to the second inflatable packer before the well tool is positioned within the wellbore. The tubular connection can be configured to allow fluid communication between the inflation tool and the second inflatable packer. The well tool can include a backflow prevention device connected to the tubular connection. The backflow prevention device can be positioned closer to the second inflatable packer than to the inflation tool. The backflow prevention device can be configured to allow fluid to flow through the backflow prevention device from the inflation to the second inflatable packer. The backflow prevention device can be configured to prevent fluid from flowing through the backflow prevention device from the second inflatable packer to the inflation tool. The tubular connection can include an engineered weak point positioned along the tubular connection closer to the second inflatable packer than to the inflation tool. The tubular connection can be configured to break at the engineered weak point in response to an application of tension strain on the tubular connection.

After inflating the second inflatable packer, the inflation tool can be moved away from the second inflatable packer, such that the tubular connection breaks at the engineered weak point. After inflating the second inflatable packer, the inflation tool can be removed from within the wellbore.

The deformable liner can include a first slotted end and a second slotted end opposite the first slotted end.

The first slotted end can be flared radially outward. The second slotted end can be flared radially outward.

A piece of equipment can be guided to the deformable liner with the flared first slotted end or the flared second slotted end.

A ratio of the inner liner diameter after the deformable liner is deformed to the inner liner diameter before the deformable liner is deformed can be in a range of approximately 1.02 to approximately 3.

Certain aspects of the subject matter described here can be implemented as a method. A deformable liner, a first inflatable packer (positioned within the deformable liner), and a second inflatable packer (positioned around the deformable liner) is positioned within a wellbore. An inner liner diameter of the deformable liner is increased by inflating the first inflatable packer. After increasing the inner liner diameter of the deformable liner, the deformable liner is permanently secured within the wellbore by inflating the second inflatable packer.

This, and other aspects, can include one or more of the following features.

Before being positioned within the wellbore, the second inflatable packer can define an initial outer diameter. Increasing the inner liner diameter of the deformable liner can include increasing the inner liner diameter of the deformable liner to at least equal to or greater than the initial outer diameter.

After increasing the inner liner diameter of the deformable liner, the first inflatable packer can be deflated. After increasing the inner liner diameter of the deformable liner, the first inflatable packer can be removed from within the deformable liner.

Permanently securing the deformable liner within the wellbore can include contacting the second inflatable packer to an inner wall of the wellbore.

Permanently securing the deformable liner within the wellbore can include flowing a hardening fluid into the second inflatable packer. Permanently securing the deformable liner within the wellbore can include allowing the hardening fluid to harden within the second inflatable packer.

Certain aspects of the subject matter described here can be implemented as a well tool. The well tool includes a deformable liner configured to be positioned within a wellbore. The deformable liner is configured to be deformed radially. The well tool includes a first inflatable packer configured to be positioned within the deformable liner. The first inflatable packer is configured to be inflated while positioned within the deformable liner to deform the deformable liner radially. The well tool includes a second inflatable packer configured to be positioned around the deformable liner. The second inflatable packer is configured to be inflated to an inner wall of the wellbore.

This, and other aspects, can include one or more of the following features.

The second inflatable packer, before being inflated, can define an initial outer diameter of the well tool. The first inflatable packer can be configured to be inflated while positioned within the deformable liner to deform the deformable liner radially, such that the deformable liner, after being deformed radially, defines an inner liner diameter that is greater than the initial outer diameter of the well tool.

The deformable liner can define an inner liner diameter. The deformable liner can be configured to be deformed radially, such that a ratio of the inner liner diameter after being deformed radially to the inner liner diameter before being deformed radially is in a range of approximately 1.02 to approximately 3.

The well tool can include an inflation tool fluidically coupled to each of the first inflatable packer and the second inflatable packer, independently. The inflation tool can be configured to convey hydraulic pressure to inflate each of the first inflatable packer and the second inflatable packer, independently.

The well tool can include a tubular connection connecting the inflation tool to the second inflatable packer before the well tool is positioned within the wellbore. The tubular connection can be configured to allow fluid communication between the inflation tool and the second inflatable packer. The well tool can include a backflow prevention device connected to the tubular connection. The backflow prevention device can be positioned closer to the second inflatable packer than to the inflation tool. The backflow prevention device can be configured to allow fluid to flow through the backflow prevention device from the inflation tool to the second inflatable packer. The backflow prevention device can be configured to prevent fluid from flowing through the backflow prevention device from the second inflatable packer to the inflation tool. The tubular connection can include an engineered weak point positioned along the tubular connection closer to the second inflatable packer than to the inflation tool. The tubular connection can be configured to break at the engineered weak point in response to an application of tension strain on the tubular connection.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

The subject matter described in this disclosure can be implemented in particular implementations, so as to realize one or more of the following advantages. A liner can be installed within a wellbore, so that additional equipment can be run and deployed in the well. Using a deformable liner allows for the inner diameter to be tailored to the equipment to be installed within the wellbore. Using a deformable liner allows for the liner to be installed within the wellbore without introducing a new (smaller) restriction in the well. For example, the deformable liner can be expanded, such that the inner liner diameter of the deformable liner is equal to or greater than the smallest existing inner diameter in the well (such as the production tubing). The deformable liner can include slotted ends, which can flare out radially to form flared ends. The flared ends of the deformable liner can contact an inner wall of the well bore, and the flared ends can aid intervention of tool strings through the expanded deformable liner. The flared ends of the deformable liner can support and center the liner within the wellbore.

Figure 1A:
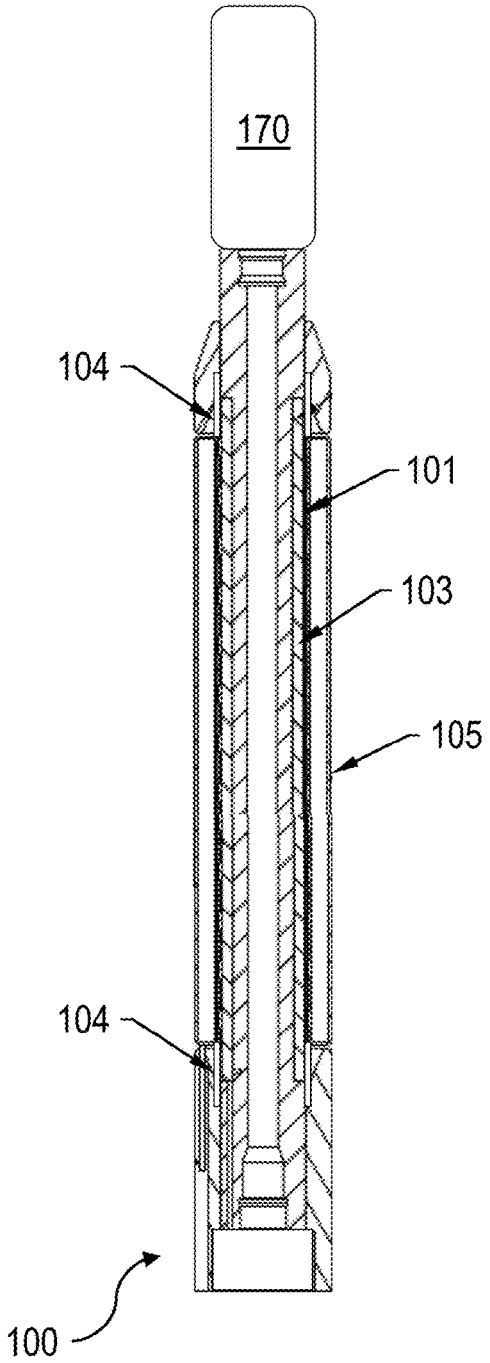
FIG. 1A is a cross-sectional view of an example well tool.
Figure 1B:
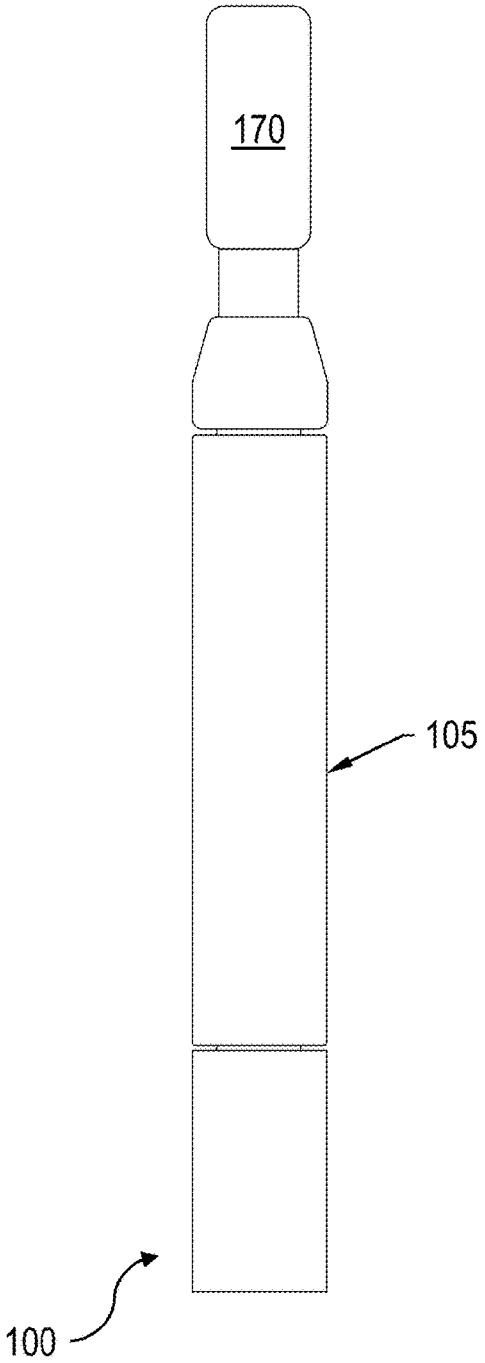
FIG. 1B is an outer view of the well tool of FIG. 1A.
Figure 2A:
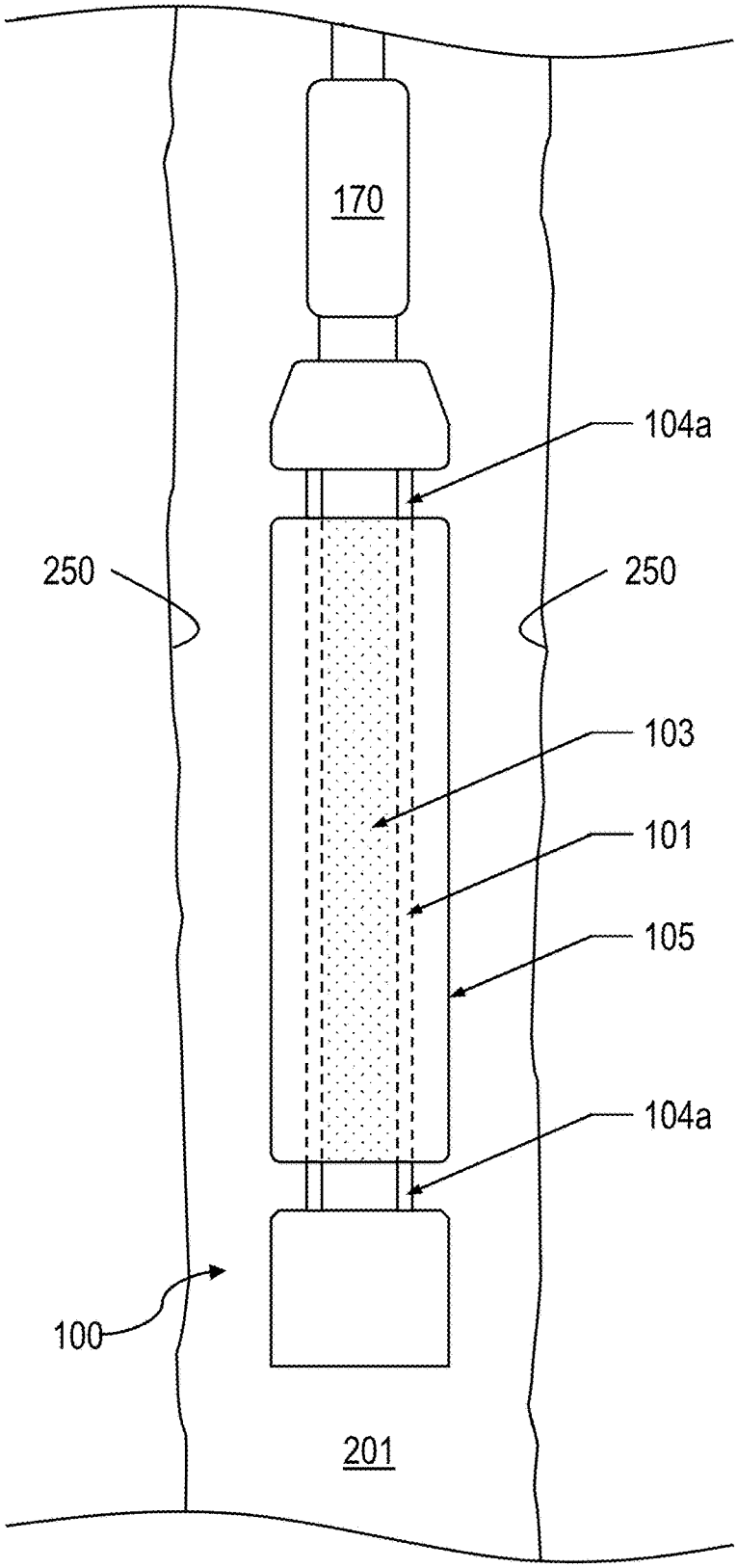
FIGS. 2A, 2B, and 2C are schematics of the well tool of FIG. 1A within a wellbore.

FIG. 1A shows a cross-sectional view of a well tool 100. FIG. 1B shows an external view of the well tool 100. The well tool 100 includes a deformable liner 101, a first inflatable packer 103, and a second inflatable packer 105. The deformable liner 101 is configured to be positioned within a wellbore (an example wellbore 201 is shown in FIG. 2A). The first inflatable packer 103 is configured to be positioned within the deformable liner 101. The second inflatable packer 105 is configured to be positioned around the deformable liner 101. The well tool 100 can include an inflation tool 170. The inflation tool 170 is coupled to the first inflatable packer 103 and to the second inflatable packer 105, independently.

Figure 1C:
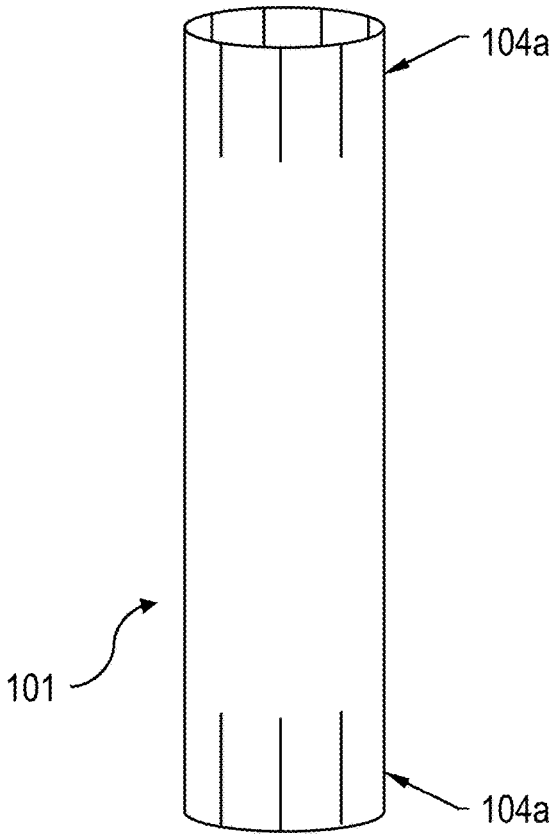
FIGS. 1C and 1D are views of an example deformable liner.
Figure 1D:
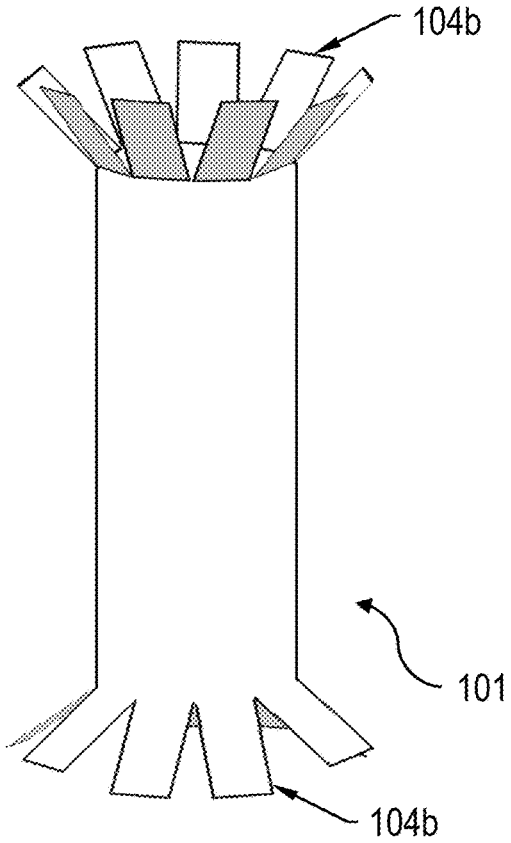

The deformable liner 101 can have a tubular shape. The deformable liner 101 is configured to be deformed radially. Therefore, an inner liner diameter of the deformable liner 101 can be altered. For example, the inner liner diameter of the deformable liner 101 can be increased by applying pressure in an outwardly radial direction to an inner surface of the deformable liner 101. To maintain a similar cross-sectional shape before and after deforming the deformable liner 101, a substantially equal amount of pressure can be applied in all radial directions. The deformable liner 101 can be deformed, such that a ratio of an inner liner diameter after the deformable liner 101 is deformed to an inner liner diameter before the deformable liner 101 is deformed is in a range of approximately 1.02 to approximately 3. For example, the deformable liner 101 can be deformed, such that its final inner liner diameter after deformation is approximately 2 times its initial liner diameter before deformation. In some implementations, the deformable liner 101 can be deformed, such that a ratio of an inner liner diameter after the deformable liner 101 is deformed to an inner liner diameter before the deformable liner 101 is deformed is in a range of approximately 1.02 to approximately 2, approximately 1.02 to approximately 1.9, approximately 1.02 to approximately 1.75, or approximately 1.02 to approximately 1.5. As the inner liner diameter of the deformable liner 101 expands, the outer liner diameter of the deformable liner 101 can also expand. As the inner liner diameter of the deformable liner 101 expands, the thickness (that is, the difference between the outer diameter and the inner diameter) of the deformable liner 101 may decrease. Non-limiting examples of suitable materials for the deformable liner 101 are metals or metallic materials, such as stainless steel (for example, 304L class stainless steel), Inconel Alloy 625 (Unified Numbering System N06625), and Alloy C276 (Unified Numbering System N10276). In some implementations, the deformable liner 101 is made of a material that is corrosion resistant. In some implementations, the deformable liner 101 remains corrosion resistant after plastic deformation. In some implementations, the deformable liner 101 includes a thermoplastic polymer, such as polyether ether ketone. Examples of the deformable liner 101 are also shown in FIGS. 1C and 1D and are described in more detail.

Referring back to FIGS. 1A and 1B, the first inflatable packer 103 is configured to inflate while positioned within the deformable liner 101. The first inflatable packer 103 can be expanded radially. Because the first inflatable packer 103 is positioned within the deformable liner 101, a radial expansion of the first inflatable packer 103 causes the deformable liner 101 to deform (for example, expand) radially. A longitudinal length of the first inflatable packer 103 can be at least equal to a longitudinal length of the deformable liner 101. The first inflatable packer 103 can have a shape of a pouch or sleeve. In some implementations, the first inflatable packer 103 can have an elongated toroidal shape. Suitable materials for the first inflatable packer 103 can endure pressures greater than a deformation pressure of the deformable liner 101 (that is, a pressure at which the deformable liner 101 deforms), allowing the first inflatable packer 103 to apply radial pressure across an inner surface of the deformable liner 101 and effectively deform the deformable liner 101 without rupturing the first inflatable packer 103. In some implementations, the first inflatable packer 103 is designed to withstand pressures of 5,000 pounds per square inch (psi) or more without rupturing. A non-limiting example of a suitable material for the first inflatable packer 103 is reinforced rubber. In some implementations, the first inflatable packer 103 has a tubular shape with pressure connections (for example, steel pressure connections) on both ends of the first inflatable packer 103 (similar to a hydraulic hose). In some implementations, the first inflatable packer 103 includes layers of rubber and reinforcement layers of fabric.

When positioned within the deformable liner 101, the first inflatable packer 103 can be inflated to deform the deformable liner 101. The first inflatable packer 103 can be inflated by flowing fluid from the inflation tool 170 to the first inflatable packer 103. The fluid flowed into the first inflatable packer 103 can be any fluid that is compatible with the first inflatable packer 103; that is, the fluid flowed into the first inflatable packer 103 does not degrade or otherwise react with the material that makes up the first inflatable packer 103. Some non-limiting examples of fluid that can be flowed into the first inflatable packer 103 to inflate the first inflatable packer 103 include water, oil, gas, or any combination of these. By inflating the first inflatable packer 103 while the first inflatable packer 103 is positioned within the deformable liner 101, pressure is applied in an outwardly radial direction on the deformable liner 101, thereby causing the deformable liner 101 to deform radially. The deformation of the deformable liner 101 can also cause the second packer 105 to deform, shift, or move, without the second packer 105 being inflated with another fluid. In some implementations, the inflation of the first inflatable packer 103 is volume controlled, in order to accurately and precisely control the expansion of the deformable liner 101. The first inflatable packer 103 should inflate, such that the deformable liner 101 expands to a point at which the inner liner diameter of the expanded deformable liner 101 is equal to or greater than an initial outer diameter of the well tool 100 (for example, before the well tool 100 is positioned within a wellbore) and also at which the deformable liner 101 does not rupture. In some implementations, the expanded deformable liner 101 has an inner liner diameter that is equal to or greater than an inner diameter of the smallest existing restriction of the well, such as the production tubing or a nipple profile.

The second inflatable packer 105 is configured to be inflated to an inner wall of the wellbore. A longitudinal length of the second inflatable packer 105 can be at least equal to the longitudinal length of the deformable liner 101. The second inflatable packer 105 can have a shape of a pouch or sleeve. In some implementations, the second inflatable packer 105 can have an elongated toroidal shape. The second inflatable packer 105 can define an inner volume defined by its toroidal shape, within which the deformable liner 101 can be placed, such that the second inflatable packer 105 surrounds the deformable liner 101. Before being inflated, the second inflatable packer 105 can define an initial outer diameter of the well tool 100. In relation, the first inflatable packer 103 can inflate while positioned within the deformable liner 101 to deform the deformable liner 101 radially, such that the deformable liner 101 (after being deformed radially) defines an inner liner diameter that is greater than the initial outer diameter of the well tool 100.

A non-limiting example of a suitable material for the second inflatable packer 105 is reinforced rubber. In some implementations, the second inflatable packer 105 is made of a composite material, such as a mineral reinforced with an elastomeric material. In some implementations, the second inflatable packer 105 is made of a non-elastic material that can be folded and wrapped around the deformable liner 101, and the second inflatable packer 105 is configured to unfold and inflate after the first inflatable packer 103 has inflated and deformed the deformable liner 101. In some implementations, the second inflatable packer 105 is made of an elastic material that can stretch as the second inflatable packer 105 is inflated. The second inflatable packer 105 can be resistant to rupture and abrasion. In some implementations, the second inflatable packer 105 includes fabric sheets of reinforcement material, such as fiber glass or a synthetic textile (for example, made of Aramid fiber) covered or coated with rubber. In some implementations, the second inflatable packer 105 is designed to withstand pressures of 75 psi or more.

Figure 2B:
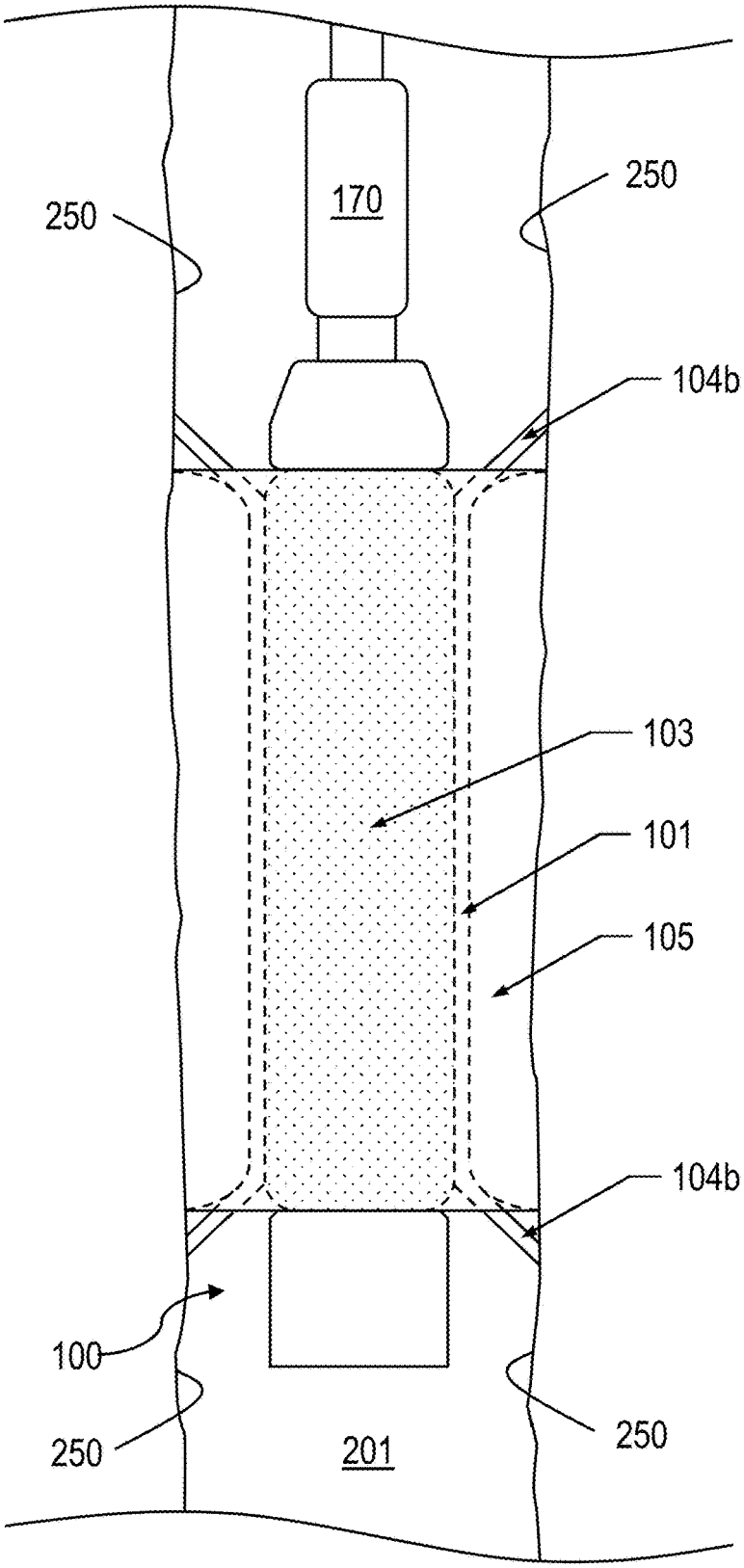

When positioned around the deformable liner 101, the second inflatable packer 105 can be inflated to contact an inner wall of the wellbore (an example of the inner wall 250 is shown in FIG. 2B). The expansion of the second inflatable packer 105 can create a seal between an outer surface of the second inflatable packer 105 and the inner wall of the wellbore and also between the outer surface of the second inflatable packer 105 and an outer surface of the deformable liner 101. Fluid can be flowed from the inflation tool 170 to the second inflatable packer 105 in order to inflate the second inflatable packer 105. In some implementations, the first inflatable packer 103 can continue to apply pressure on the inner surface of the deformable liner 101 to counter the pressure being applied by the second inflatable packer 105 on the outer surface of the deformable liner 101. The pressure from the first inflatable packer 103 can prevent the deformable liner 101 from being deformed radially inward (that is, contract), while the second inflatable packer 105 inflates. In some implementations, the first inflatable packer 103 is deflated (or the pressure being applied to the first inflatable packer 103 is removed) before the second inflatable packer 105 is inflated. The pressure applied by the second inflatable packer 105 on the outer surface of the deformable liner 101, as the second inflatable packer 105 inflates, is less than the deformation force necessary to radially reduce the diameter of the deformable liner 101. Therefore, after the deformable liner 101 has been expanded by the first inflatable packer 103, the first inflatable packer 103 can be deflated, and the second inflatable packer 105 can be inflated without causing the deformable liner 101 to contract.

The fluid flowed into the second inflatable packer 105 can be a hardening fluid that is compatible with the second inflatable packer 105; that is, the hardening fluid flowed into the second inflatable packer 105 does not degrade or otherwise react with the material that makes up the second inflatable packer 105. The hardening fluid can be a liquid substance that irreversibly solidifies. The hardening fluid can be in a liquid state until hardening of the hardening liquid is desired. For example, the hardening fluid can remain in a liquid state while the hardening fluid is being flowed into the second inflatable packer 105 to inflate the second inflatable packer 105. In some implementations, the hardening fluid begins to solidify due a temperature of the wellbore (for example, a temperature-sensitive material, such as a thermoset). In some implementations, the hardening fluid begins to solidify after a certain time period (for example, a cement or synthetic resin). In some implementations, the hardening fluid begins to solidify after a curing or cross-linking agent is introduced (for example, a curing epoxy resin). After flowing the hardening fluid to the second inflatable packer 105 to inflate and contact the wellbore, the hardening fluid within the second inflatable packer 105 can solidify, so that the position of the deformable liner 101 relative to the wellbore can be retained. Solidifying the hardening fluid in the second inflatable packer 105 can secure the deformable liner 101 to the wellbore. In some implementations, the hardening fluid includes an expanding additive configured to expand after the second inflatable packer 105 has been inflated, such that while the hardening fluid solidifies within the second inflatable packer 105, the expanding additive increases the contact force between the second inflatable packer 105 and the wellbore and the contact force between the second inflatable packer 105 and the deformable liner 101. The increased contact forces can increase the capability of the second inflatable packer 105 to anchor the deformable liner 101 within the wellbore. The increased contact forces can increase the capability of the second inflatable packer 105 to create a seal with the inner wall of the wellbore.

In some implementations, the deformable liner 101 can include slotted ends 104 at both ends of the deformable liner 101. The slotted ends 104 can flare radially outward. FIGS. 1C and 1D show examples of the deformable liner 101 with the slotted ends before flaring radially outward (104*a*) and the slotted ends flared radially outward (104*b*). As mentioned earlier, the flared ends (104*b*) can support and center the deformable liner 101 within a wellbore. The slotted ends 104 can be flared out, for example, by inflating the first inflatable packer 103 positioned within the deformable liner 101. As the first inflatable packer 103 inflates, portions of the first inflatable packer 103 can bulge out of the ends of the deformable liner 101, causing the slotted ends 104 to flare out. In some implementations, the slotted ends 104 are coupled to the second inflatable packer 105. For example, the slotted ends 104 can be strapped to the second inflatable packer 105, such that when the second inflatable packer 105 (surrounding the deformable liner 101) is inflated, the slotted ends 104 flare out, toward the second inflatable packer 105. In some implementations, the length (L) of the slotted ends 104 is defined by the following equation:

$$L=(D_o-D_i)\sin(\theta)$$

where $D_o$ is the diameter of the wellbore within which the deformable liner 101 is positioned, $D_i$ is the inner diameter of the deformable liner 101 after the deformable liner 101 has been deformed by the first inflatable packer 103, and θ is the desired flaring angle of the slotted ends 104. In some implementations, the flaring angle θ is in a range of approximately 5° to approximately 170°.

Figure 1E:
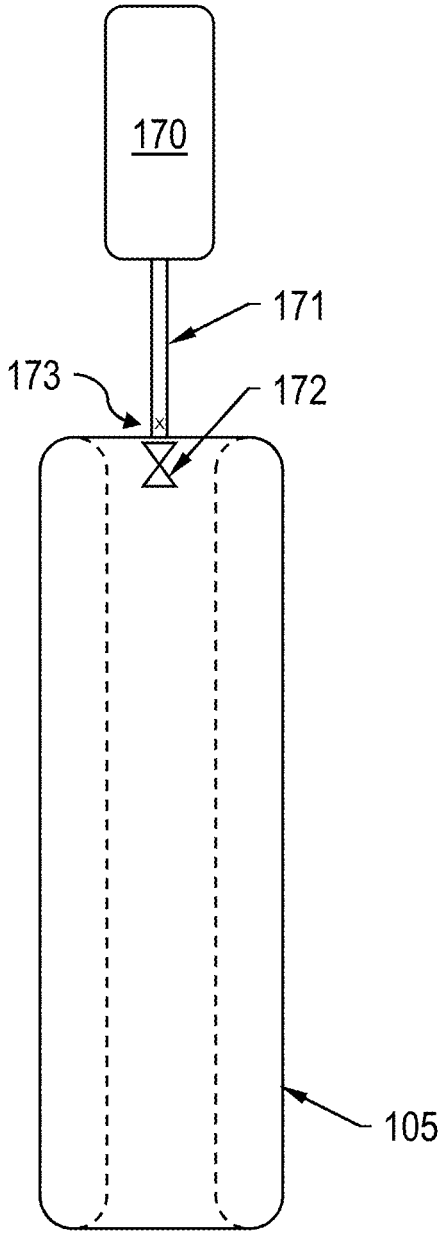
FIGS. 1E and 1F are views of an example inflation tool connected to an example inflatable packer.
Figure 1F:
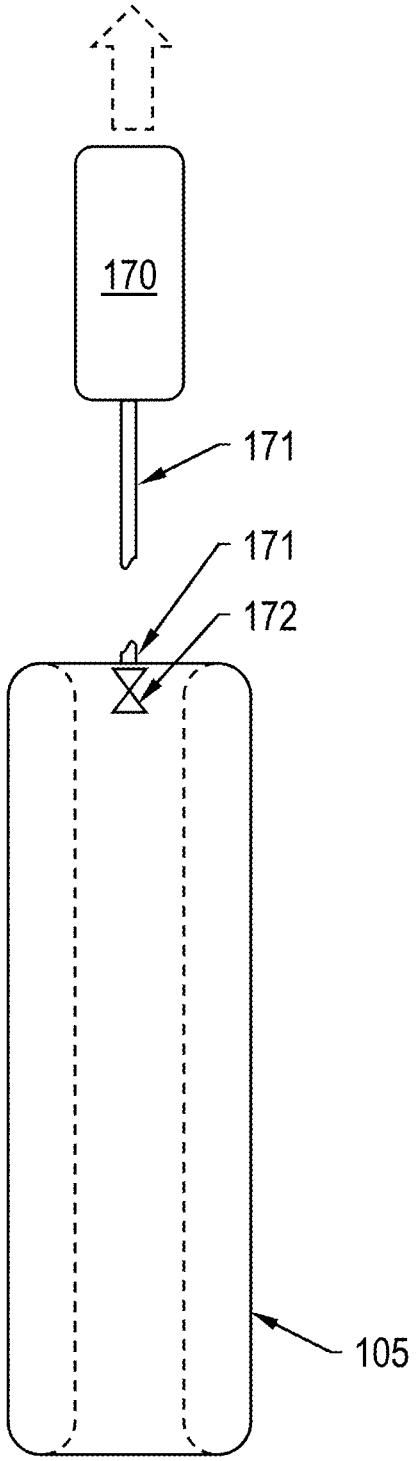

FIGS. 1E and 1F show examples of the inflation tool 170 and the second inflatable packer 105. The inflation tool 170 is configured to convey hydraulic pressure to inflate the first inflatable packer 103 and the second inflatable packer 105, independently. Fluids can be flowed through the inflation tool 170 to each of the first and second inflatable packers (103, 105) using, for example, one or more pumps. The inflation tool 170 can be connected to the one or more pumps by, for example, a hydraulic tether (such as coiled tubing). The inflation tool 170 includes a tubular connection 171 connecting the inflation tool 170 to the second inflatable packer 105 (for example, before the well tool 100 is positioned within a wellbore). The tubular connection 171 is configured to allow fluid communication between the inflation tool 170 and the second inflatable packer 105.

Although not illustrated, the inflation tool 170 can also include another tubular connection connecting the inflation tool 170 to the first inflatable packer 103 to allow fluid communication between the inflation tool 170 and the first inflatable packer 103. In some implementations, the inflation tool 170 includes a first compartment with fluid for inflating the first inflatable packer 103 and a second compartment with fluid (such as hardening fluid) for inflating the second inflatable packer 105. The first compartment and second compartment of the inflation tool 170 can be operated similarly to, for example, hydraulic cylinders. Each of the first compartment and the second compartment of the inflation tool 170 can include pistons, which can be actuated, for example, by the one or more pumps connected to the inflation tool 170 by a hydraulic tether. Actuating the piston of the first compartment can pressurize the fluid within the first compartment and cause the fluid to flow into the first inflatable packer 103, thereby causing the first inflatable packer 103 to inflate. Actuating the piston of the second compartment can pressurize the fluid within the second compartment and cause the fluid to flow into the second inflatable packer 105 (through the tubular connection 171), thereby causing the second inflatable packer 105 to inflate. In some implementations, the fluids that are flowed into the first inflatable packer 103 and the second inflatable packer 105 can be flowed from the surface (for example, from a wellhead pump) through the inflation tool 170. In order to achieve the precise volume controlled inflation of the first inflatable packer 103 (mentioned earlier), the inflation tool 170 can be configured to provide a predetermined amount of fluid to the first inflatable packer 103. For example, the piston of the first compartment can have a predetermined length corresponding to the predetermined amount of fluid or the piston can be configured to be actuated for a predetermined length corresponding to the predetermined amount of fluid for the first inflatable packer 103. In some implementations, a valve of the inflation tool 170 is actuated to prevent more fluid from entering the first inflatable packer after the predetermined amount of fluid is flowed into the first inflatable packer 103.

The tubular connection 171 can include a backflow prevention device 172 (such as a check valve). As shown in FIGS. 1E and 1F, the backflow prevention device 172 can be located within the second inflatable packer 105. The backflow prevention device 172 is configured to allow fluid to flow through the backflow prevention device 172 from the inflation tool 170 (and through the tubular connection 171) to the second inflatable packer 105. The backflow prevention device 172 is configured to prevent fluid from flowing through the backflow prevention device 172 from the second inflatable packer 105 to the inflation tool 170. The tubular connection 171 includes an engineered weak point 173 positioned along the tubular connection 171 closer to the second inflatable packer 105 than to the inflation tool 170. For example, in the direction of fluid flow from the inflation tool 170 to the second inflatable packer 105, the engineered weak point 173 is located along the tubular connection 171 upstream of the backflow prevention device 172. The tubular connection 171 is configured to break at the engineered weak point 173 in response to an application of tension strain on the tubular connection 171. It is desirable for the engineered weak point 173 to be as close to the second inflatable packer 105 as possible to minimize the amount of the tubular connection 171 left connected to the second inflatable packer 105 after the tubular connection 171 has been broken at the engineered weak point 173. FIG. 1E shows the inflation tool 170 connected to the second inflatable packer 105 with an intact tubular connection 171. FIG. 1F shows the inflation tool 170 disconnected from the second inflatable packer 105, after the inflation tool 170 has been moved away from the second inflatable packer 105, thereby applying a tension strain on the tubular connection 171, causing the tubular connection 171 to break at the engineered weak point 173. Even after the tubular connection 171 has broken, the backflow prevention device 172 prevents fluid from flowing out of the second inflatable packer 105 through the broken tubular connection 171.

Figure 2C:
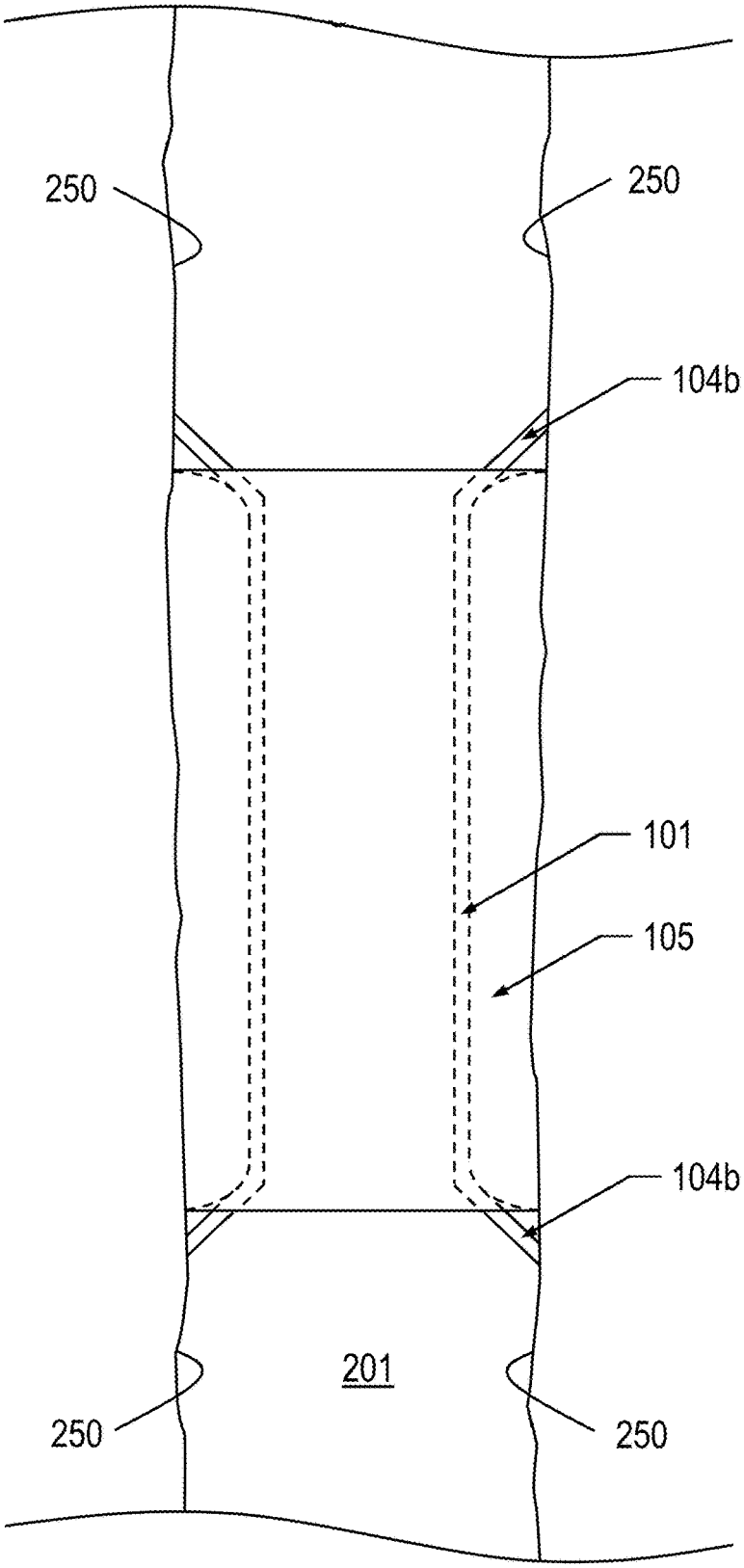

FIGS. 2A, 2B, and 2C show the well tool 100 positioned within a wellbore 201. Although the wellbore 201 shown in FIGS. 2A, 2B, and 2C is vertical, the well tool 100 can be positioned and used within a wellbore that has any orientation, such as horizontal or otherwise at any other angle that deviates from a vertical orientation. The initial outer diameter of the well tool 100, including the second inflatable packer 105 before the well tool 100 is positioned within the wellbore 201 (and before the first inflatable packer 103 is inflated to deform the deformable liner 101) is smaller than the smallest existing restriction in the well (along a longitudinal axis of the wellbore 201), so that the well tool 100 can travel through the well to the desired location within the wellbore 201.

Once the well tool 100 is positioned within the wellbore 201 at the desired location (as shown in FIG. 2A), fluid can be flowed to the first inflatable packer 103 (for example, with the inflation tool 170) to inflate the first inflatable packer 103 and radially deform the deformable liner 101. The first inflatable packer 103 can be inflated, such that the deformable liner 101 is expanded radially to increase the inner liner diameter to at least equal to (or greater than) the initial outer diameter of the well tool 100 (as shown in FIG. 2B). While or after inflating the first inflatable packer 103, fluid (such as the hardening fluid) can be flowed to the second inflatable packer 105 (for example, with the inflation tool 170) to inflate the second inflatable packer 105 and contact an inner wall 250 of the wellbore 201. The slotted ends 104 can flare radially outward (104*b*) and contact the inner wall 250 of the wellbore 201. The hardening fluid can be allowed to solidify within the second inflatable packer 105 in order to maintain the position of the deformable liner 101 relative to the wellbore 201.

The first inflatable packer 103 can be deflated and removed from the wellbore 201. Because the inner liner diameter is increased to at least equal to the initial outer diameter of the well tool 100, the remaining portions of the well tool 100 (excluding the deformable liner 101 and the second inflatable packer 105) can be removed from the wellbore 201 through the (now expanded) deformable liner 101 itself. The remaining portions (such as the inflation tool 170) can also be removed from the wellbore 201 through the expanded deformable liner 101. Removing the inflation tool 170 can include moving the inflation tool 170 away from the second inflatable packer 105, causing the tubular connection 171 to break at the engineered weak point 173. The deformable liner 101 with increased inner liner diameter (with flared slotted ends 104*b*) and inflated second inflatable packer 105 can securely stay put within the wellbore 201 (as shown in FIG. 2C) for additional equipment to be installed within the wellbore 201.

Figure 3:
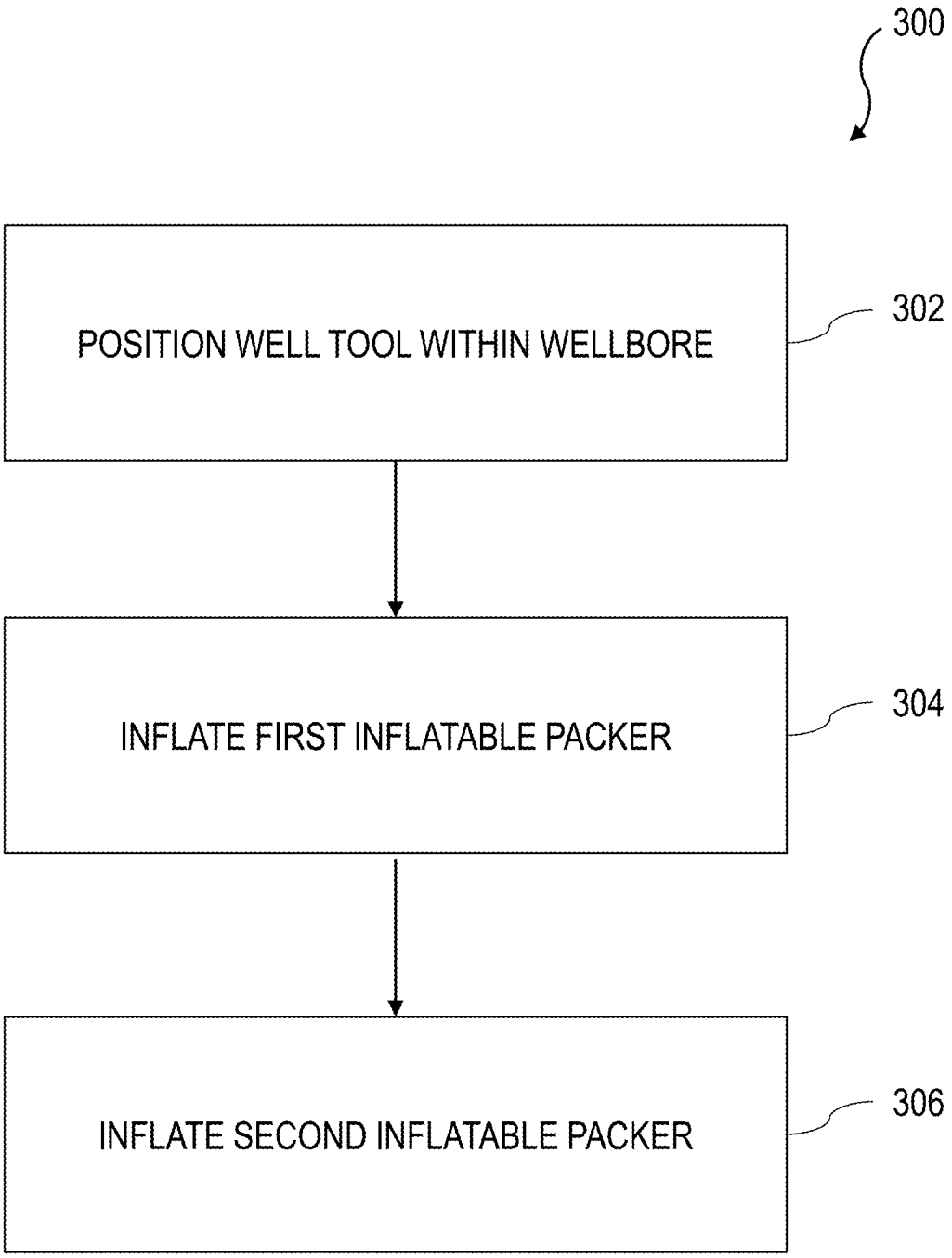
FIG. 3 is a flow chart of an example method for using inflatable packers within a wellbore.

FIG. 3 is a flow chart for a method 300. At 302, a well tool (such as the well tool 100) is positioned within a wellbore (such as the wellbore 201). At 304, a first inflatable packer (103) positioned within a deformable liner (101) is inflated to deform the deformable liner 101. After inflating the first inflatable packer 103, the inner liner diameter of the deformable liner 101 is equal to or greater than the initial outer diameter of the well tool 100. In some implementations, a ratio of the inner liner diameter after the deformable liner 101 is deformed at 304 to the inner liner diameter before the deformable liner 101 is deformed at 304 is in a range of approximately 1.02 to approximately 3. Inflating the first inflatable packer 103 can include flowing fluid (for example, using the inflation tool 170) to the first inflatable packer 103. After the first inflatable packer 103 is inflated to deform the deformable liner 101 at 302, the first inflatable packer 101 can be removed from within the deformable liner 101.

At 306, a second inflatable packer (105) positioned around the deformable liner 101 is inflated to sealably contact an inner wall of a wellbore (201). Inflating the second inflatable packer 105 can include flowing a hardening fluid (for example, using the inflation tool 170) into the second inflatable packer 105 and allowing the hardening fluid to solidify within the second inflatable packer 105, such that the second inflatable packer remains permanently inflated. After inflating the second inflatable packer 105, the inflation tool 170 can be moved away from the second inflatable packer 105, such that a tubular connection (171) of the inflation tool 170 breaks at an engineered weak point (173). The inflation tool 170 can then be removed from within the wellbore 201. The slotted ends 104 of the deformable liner 101 can be flared radially outward by inflating the first inflatable packer 103 at 302, by inflating the second inflatable packer 105 at 304, or a combination of both. The deformable liner 101 (after being deformed at 304) and the second inflatable packer 105 (after being inflated at 306) can be secured within the wellbore 201. A piece of equipment can be guided to the expanded deformable liner 101 with the flared slotted ends 104*b*.

Figure 4:
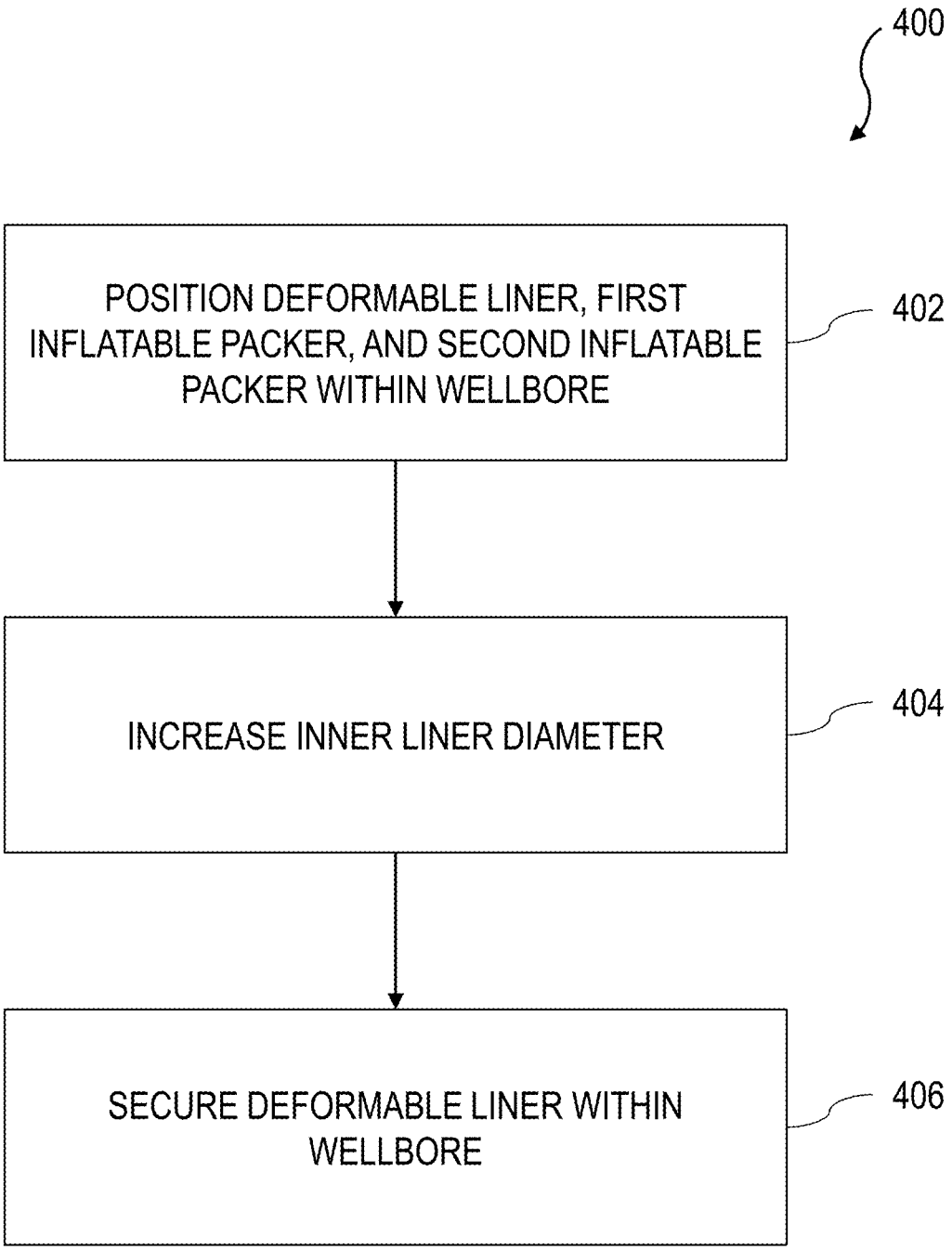
FIG. 4 is a flow chart of an example method for using inflatable packers within a wellbore.

FIG. 4 is a flow chart for a method 400. The method 400 can be applicable to, for example, the well tool 100 positioned within a wellbore (such as the wellbore 201). At 402, a deformable liner (101), a first inflatable packer (103) positioned within the deformable liner 101, and a second inflatable packer (105) positioned around the deformable liner 101 is positioned within the wellbore 201. At 404, an inner liner diameter of the deformable liner 101 is increased by inflating the first inflatable packer 103, which is positioned within the deformable liner 101. Before being positioned within the wellbore 201, the second inflatable packer 105 can define an initial outer diameter of the tool 100. Increasing the inner liner diameter of the deformable liner 101 at 404 can include increasing the inner liner diameter to at least equal to or greater than the initial outer diameter of the tool 100. After the inner liner diameter of the deformable liner 101 is increased at 404, the first inflatable packer 103 can be deflated and removed from within the deformable liner 101.

At 406, after increasing the inner liner diameter (404), the deformable liner 101 is permanently secured within the wellbore 201 by inflating the second inflatable packer 105, which is positioned around the deformable liner 101. Permanently securing the deformable liner 105 within the wellbore 201 can include contacting the second inflatable packer 105 to an inner wall (250) of the wellbore 201. A hardening fluid can be flowed into the second inflatable packer 105 and can be allowed to harden within the second inflatable packer 105, so that the deformable liner 101 is permanently secured within the wellbore 201. Once the second inflatable packer 105 is inflated to a predetermined pressure, the inflation tool 170 can stop providing fluid to the second inflatable packer 105. This condition of meeting the predetermined pressure within the second inflatable packer 105 can be detected, for example, by a pressure change in a coiled tubing fluid circulation system, a control line with a bottom hole assembly or connected to the inflation tool 170, or wireless communication from a bottom hole assembly. In some implementations, the inflation tool 170 provides fluid to the second inflatable packer 105 at a constant rate, and the inflation tool 170 stops providing fluid after a predetermined duration of time corresponding to reaching the predetermined pressure within the second inflatable packer 105.

Figure 5A:
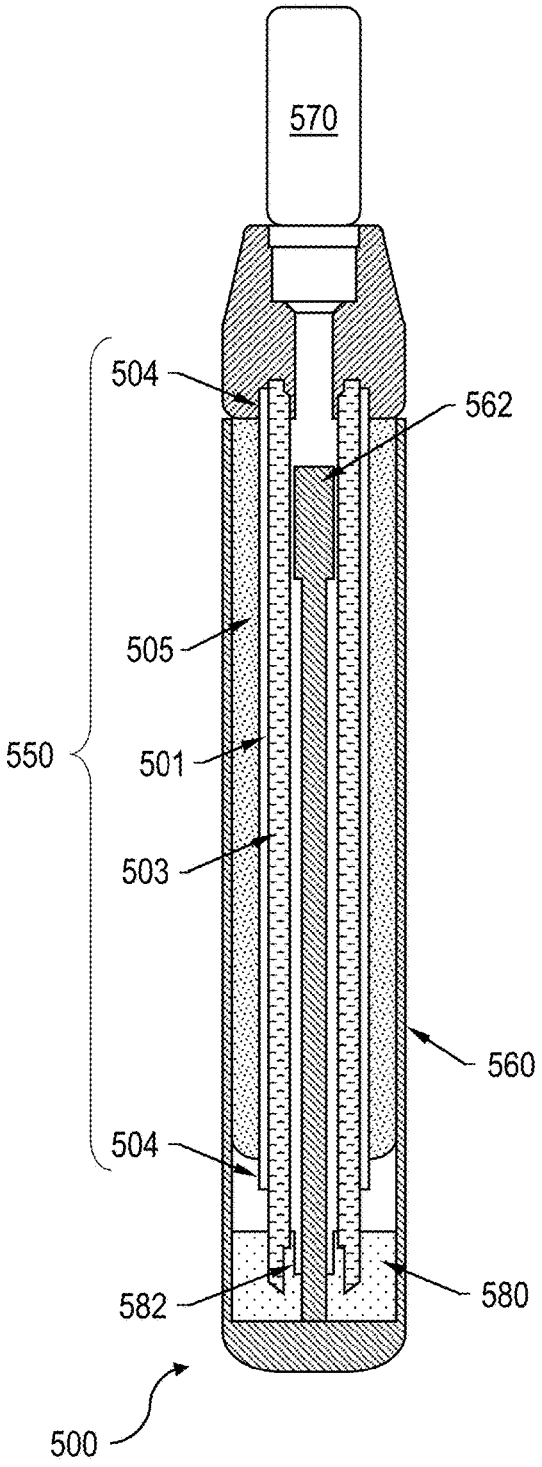
FIG. 5A is a cross-sectional view of an example well tool.
Figure 5B:
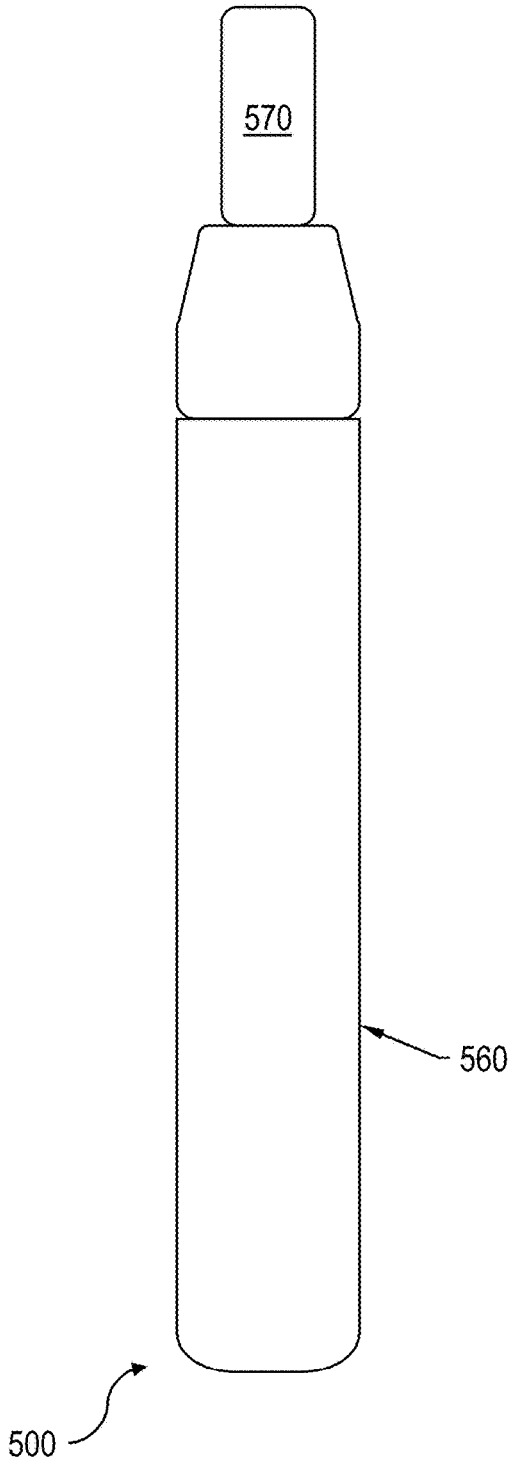
FIG. 5B is an outer view of the well tool of FIG. 5A.

FIG. 5A shows a cross-sectional view of a system 500. FIG. 5B shows an external view of the system 500. The system 500 includes a well tool 550 configured to be positioned within a wellbore (such as the wellbore 201). Similar to the well tool 100, the well tool 550 of system 500 can include a deformable liner 501 (with slotted ends 504), a first inflatable packer 503, and a second inflatable packer 505. In some implementations, the well tool 550 is substantially the same as the well tool 100. In some implementations, the deformable liner 501 is substantially the same as the deformable liner 101. For example, the deformable liner 501 can include slotted ends 504 in the same way that the deformable liner 101 can include slotted ends 104. In some implementations, the first inflatable packer 503 is substantially the same as the first inflatable packer 103. In some implementations, the second inflatable packer 505 is substantially the same as the second inflatable packer 105.

The system 500 includes a sleeve 560 defining an inner volume. The sleeve 560 is configured to secure at least a portion of the well tool 550 within the inner volume defined by the sleeve 560, while the well tool 550 is positioned within the wellbore 201. The system 500 includes a hollow member 580 positioned within the inner volume and coupled to the well tool 550. The system 500 includes a rod 562 positioned within the inner volume and coupled to the sleeve 560. The rod 562 passes through the hollow member 580 to couple to the sleeve 560, and the rod 562 is configured to move the sleeve relative to the well tool 550 in response to a pressure applied on the rod 562. The hollow member 580 defines seat 582 configured to receive the rod 562 to restrict movement of the sleeve 560 relative to the well tool 550. The system 500 can include an inflation tool 570. In some implementations, the inflation tool 570 is substantially the same as the inflation tool 170.

The deformable liner 101 can define an inner diameter of the well tool 550. The first inflatable packer 103 (positioned within the deformable liner 101) can be configured to inflate to deform the deformable liner 101, thereby increasing the inner diameter of the well tool 550. The first inflatable packer 103 can be configured to inflate to increase the inner diameter of the well tool 550 to at least an outer diameter of the sleeve 560. A ratio of the inner diameter of the well tool 550 after being increased to the inner diameter of the well tool 550 before being increased can be in a ratio of approximately 1.02 to approximately 3.

The sleeve 560 can cover an outer radial surface of the well tool 550. For example, the sleeve can cover the outer radial surface of the second inflatable packer 505 which surrounds the deformable liner 501. The sleeve 560 can protect the well tool 550 while the system 500 is being positioned within the wellbore 201. A non-limiting example of a suitable material for the sleeve 560 is metal or an alloy, such as steel (for example, AISI 4140 chrome-molybdenum alloy steel).

Pressure can be applied on the rod 562. For example, a fluid can be flowed to apply pressure on the rod 562. The fluid flowed to the rod 562 can be any fluid that is compatible with the rod 562; that is, the fluid flowed to the rod 562 does not degrade or otherwise react with the material that makes up the rod 562. Some non-limiting examples of fluid that can be flowed to the rod 562 include water, oil, gas, or any combination of these. In response to a pressure applied on the rod 562, the rod 562 is configured to move the sleeve 560 relative to the well tool 550. The seat 582 is configured to receive the rod 562 to restrict movement of the sleeve 560 relative to the well tool 550, for example, to a predetermined distance. The predetermined distance can be at least equal to a longitudinal length of the well tool. For example, the predetermined distance can be equal to or longer than the longitudinal length of the second inflatable packer 505, so that the sleeve 560 can expose (that is, uncover) the entire length of the second inflatable packer 505 in response to pressure being applied to the rod 562. In some implementations, the hollow member 580 includes a locking mechanism, which secures (for example, couples) the sleeve 560 to the hollow member 580 when the rod 562 is received by the seat 582.

In some implementations, the first inflatable packer 503 is inflated, and pressure is applied on the rod 562 simultaneously, causing the sleeve 560 to move in relation to the well tool 550. For example, the rod 562 can be positioned within the first inflatable packer 503, so that when the first inflatable packer 503 is inflated, pressure is automatically applied to the rod 562. Once the inner diameter of the well tool 550 is increased and the first inflatable packer 503 is deflated, the first inflatable packer 503 and the sleeve 560 (plus accompanying components, such as the rod 562 and the hollow member 580) can be removed from the wellbore 201 through a region defined by the increased inner diameter of the well tool 550. The locking mechanism of the hollow member 580 described earlier can protect the hollow member 580 from getting caught or damaged as it is being removed from the wellbore 201.

Figure 6A:
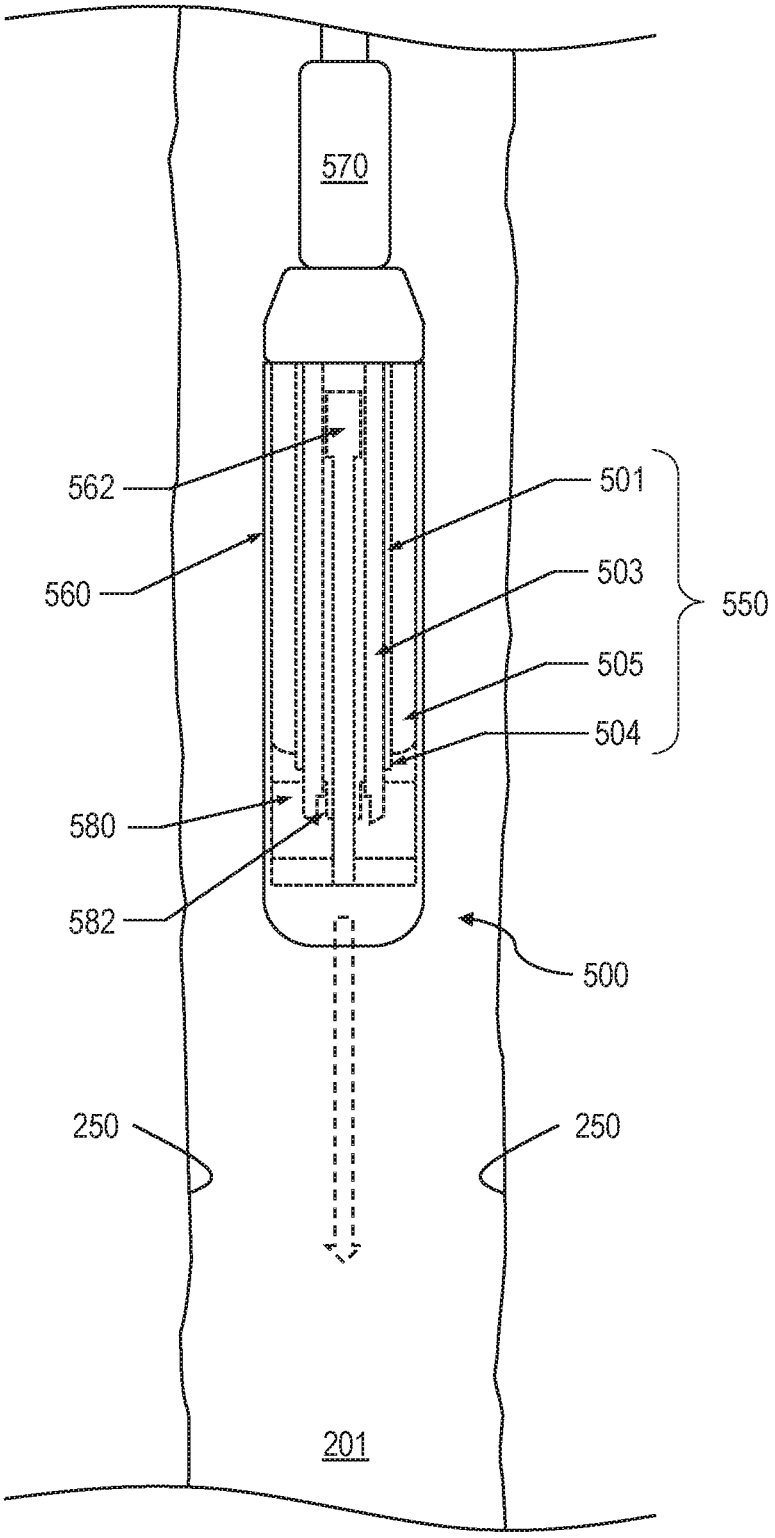
FIGS. 6A, 6B, 6C, and 6D are schematics of the well tool of FIG. 5A within a wellbore.

FIGS. 6A, 6B, 6C, and 6D show the system 500 positioned within a wellbore (such as the wellbore 201). Although the wellbore 201 shown in FIGS. 6A, 6B, 6C, and 6D is vertical, the system 500 can be positioned and used within a wellbore that has any orientation, such as horizontal or otherwise at any other angle that deviates from a vertical orientation. The outer diameter of the system 500 (for example, defined by the sleeve 560) is smaller than the smallest existing restriction in the well (along a longitudinal axis of the wellbore 201), so that the system 500 can travel through the well to the desired location within the wellbore 201. Once the system 500 is positioned within the wellbore 201 at the desired location (as shown in FIG. 6A), pressure can be applied to the rod 562 (for example, by flowing a fluid to the rod 562) to move the sleeve 560 relative to the well tool 550. As mentioned earlier, in cases where the rod 562 is positioned within the first inflatable packer 503 (as shown in FIG. 6A), pressure can be applied to the rod 562 by inflating the first inflatable packer 503. Moving the sleeve 560 relative to the well tool 550 can expose (that is, uncover) the well tool 550.

Figure 6B:
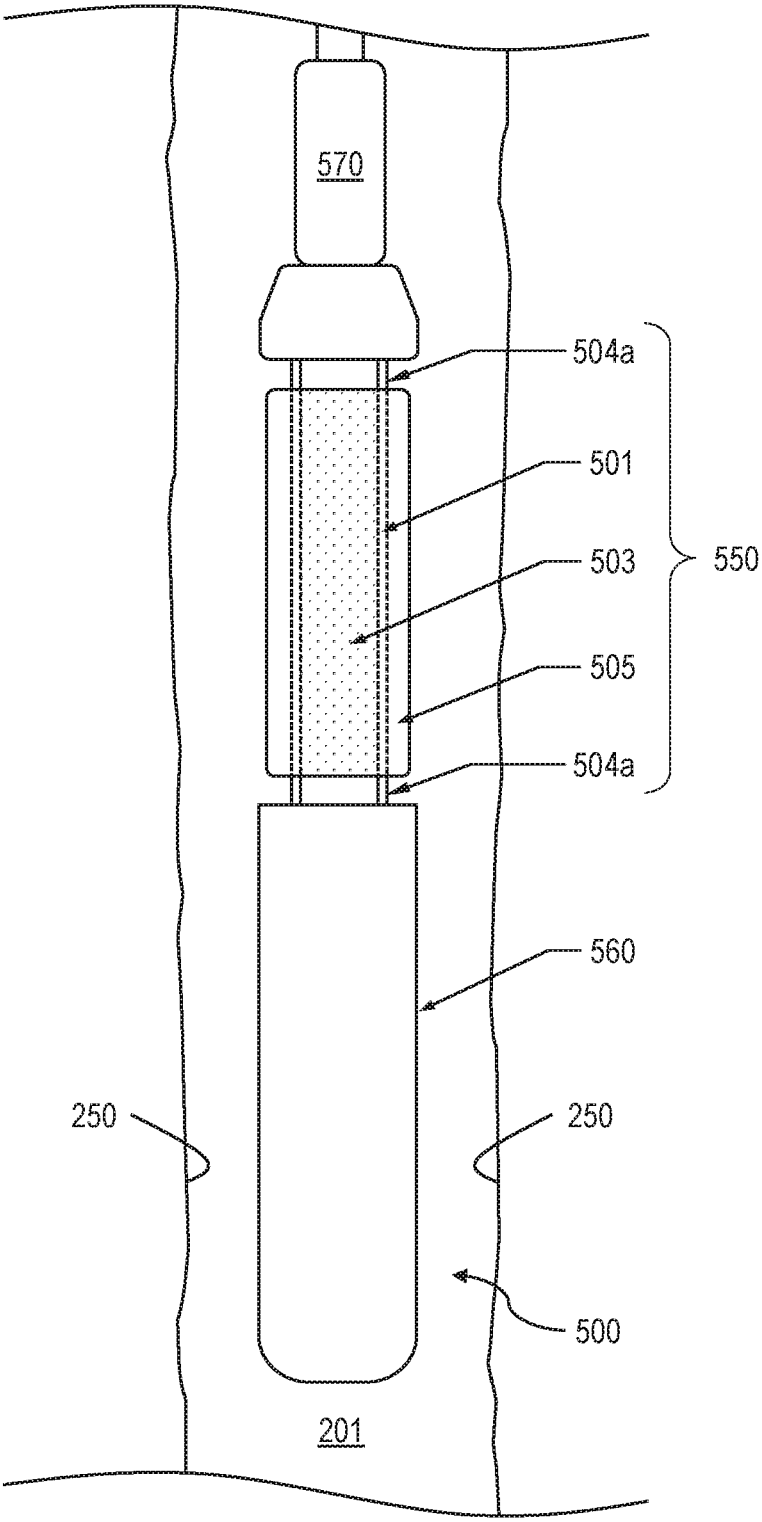
Figure 6C:
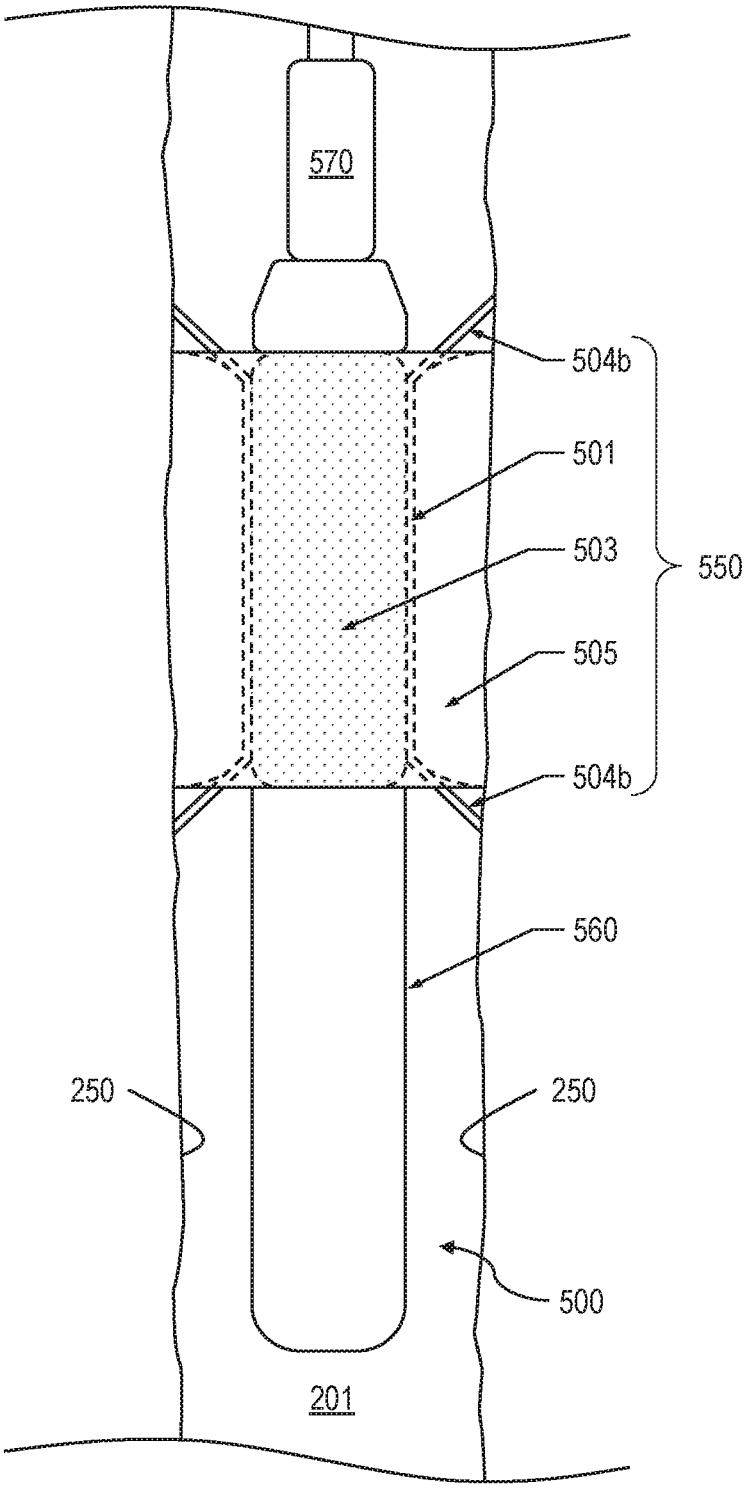
Figure 6D:
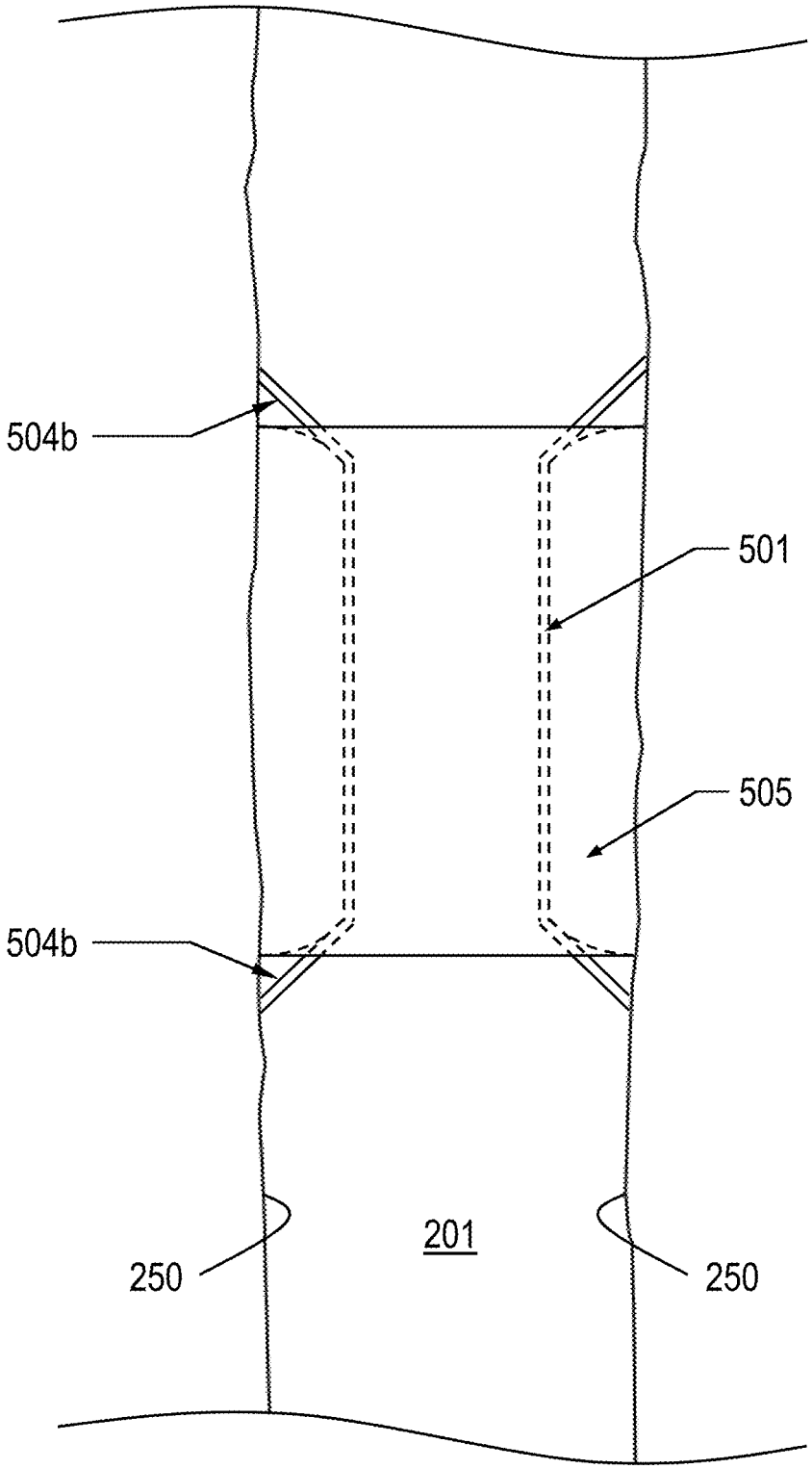

Once the outer radial surface of the well tool 550 is exposed (as shown in FIG. 6B), fluid can be flowed to the first inflatable packer 503 to inflate the first inflatable packer 503 and radially deform the deformable liner 501. As shown in FIG. 6C, the first inflatable packer 503 can be inflated, such that the deformable liner 501 is expanded radially to increase the inner liner diameter to at least the outer diameter of the sleeve 560. While or after inflating the first inflatable packer 503, fluid (such as the hardening fluid) can be flowed to the second inflatable packer 505 to inflate the second inflatable packer 505 and contact an inner wall 250 of the wellbore 201. FIG. 6B shows slotted ends 504 before they are radially flared outward (504*a*). The slotted ends 504 can flare radially outward (504*b*) and contact the inner wall 250 of the wellbore 201. The hardening fluid can be allowed to solidify in order to maintain the position of the deformable liner 501 relative to the wellbore 201. The first inflatable packer 503 can be deflated and removed from the wellbore 201. Because the inner liner diameter is increased to at least the outer diameter of the sleeve 560, the remaining portions of the system 500 (excluding the deformable liner 501 and the second inflatable packer 505) can be removed from the wellbore 201 through the (now expanded) deformable liner 501 itself. The deformable liner 501 with increased inner liner diameter (with flared slotted ends 504*b*) and inflated second inflatable packer 505 can securely stay put within the wellbore 201 (as shown in FIG. 6D) for additional equipment to be installed within the wellbore 201.

Figure 7:
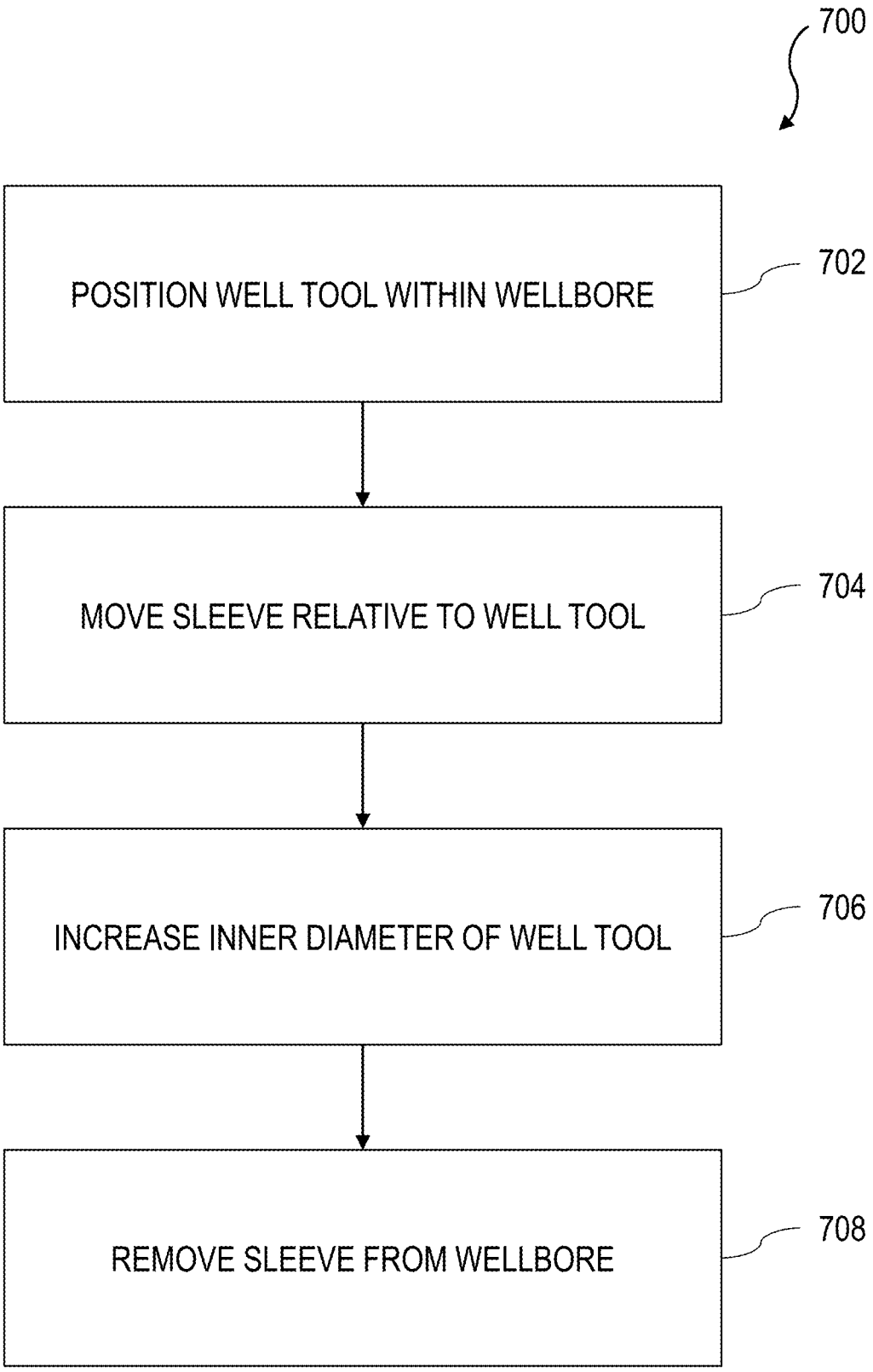
FIG. 7 is a flow chart of an example method for using a well tool within a wellbore.

FIG. 7 is a flow chart for a method 700. The method 700 can be applicable to, for example, the system 500. At 702, a well tool (such as the well tool 550) is positioned within a wellbore (such as the wellbore 201). At least a portion of the well tool 550 is secured within an inner volume defined by a sleeve (such as the sleeve 560) while the well tool 550 is positioned within the wellbore.

At 704, after positioning the well tool 550 within the wellbore 201 at 702, the sleeve 560 is moved relative to the well tool 550 to expose (that is, uncover) the previously secured portion of the well tool 550. The sleeve 560 can be moved relative to the well tool 550 by applying a pressure a rod (such as the rod 562) coupled to the sleeve 560. As described earlier, the rod 562 is positioned within the inner volume defined by the sleeve 560. The sleeve 560 and the rod 562 move together relative to the well tool 550 in response to pressure applied on the rod 562. The sleeve 560 can move along the longitudinal axis of the well tool 550. The movement of the sleeve 560 can be ceased by receiving the rod 562 in a seat (such as the seat 582) defined by a hollow member (such as the hollow member 580). As mentioned earlier, the hollow member 580 can be coupled to the well tool 550, and the rod 562 can pass through the hollow member 580 to couple to the sleeve 560.

At 706, after moving the sleeve 560 relative to the well tool 550 at 704, an inner diameter of the well tool 550 (such as the inner liner diameter of the deformable liner 501) is increased to at least an outer diameter of the sleeve 560. The inner diameter of the well tool 550 can be increased by inflating an inflatable packer of the well tool 550 (such as the first inflatable packer 503).

At 708, after increasing the inner diameter of the well tool 550 at 706, the sleeve 560 is removed from the wellbore 201 through a region of the well tool 550 defined by the increased inner diameter of the well tool 550. The deformable liner 501 (with increased inner diameter) can be secured within the wellbore before the sleeve 560 is removed from the wellbore 201.

Figure 8:
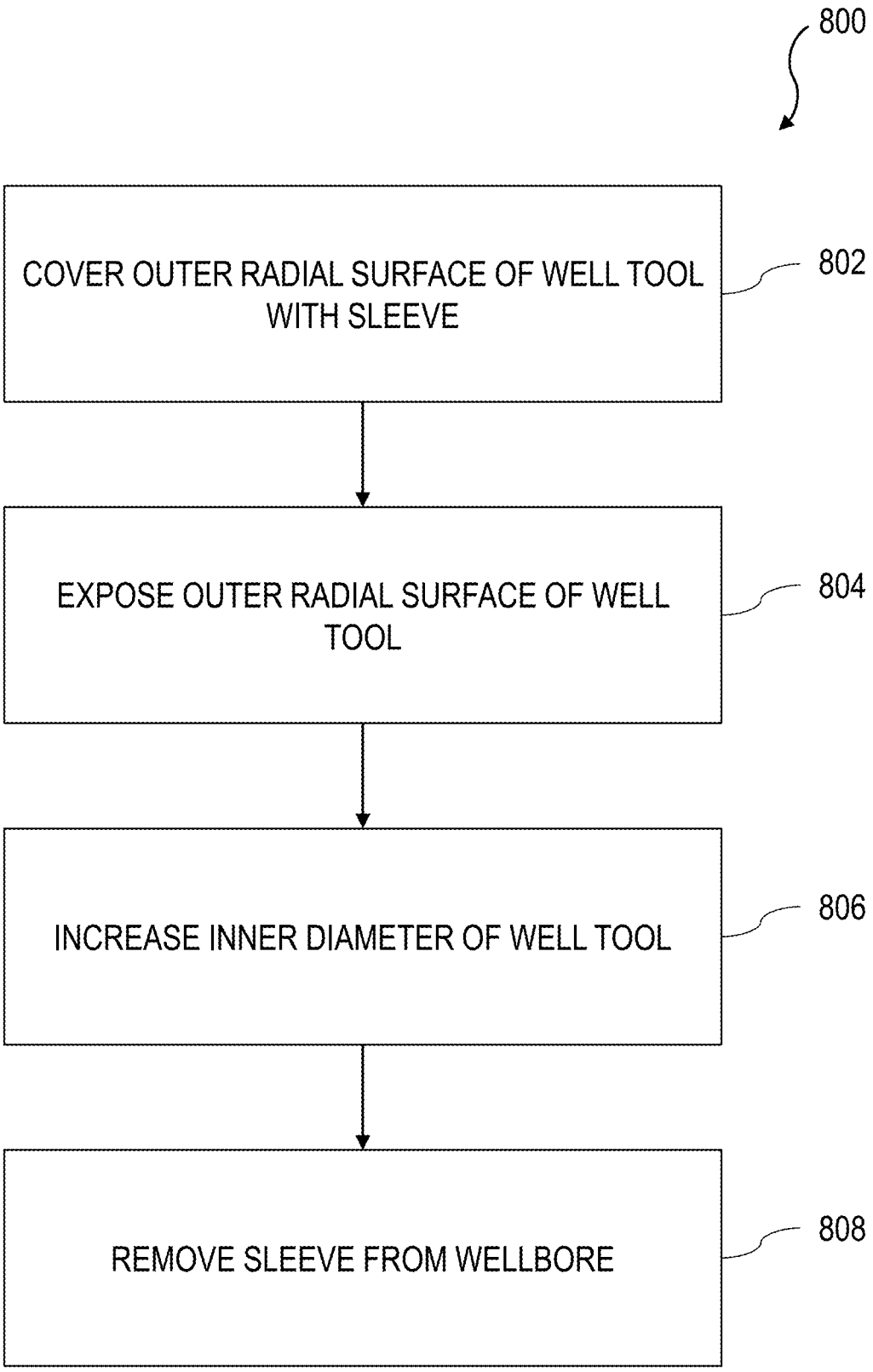
FIG. 8 is a flow chart of an example method for using a well tool within a wellbore.

FIG. 8 is a flow chart for a method 800. The method 800 can be applicable to, for example, the system 500. At 802, while a well tool (such as the well tool 550) is positioned within a wellbore (such as the wellbore 201), an outer radial surface of the well tool 550 is covered with a sleeve (such as the sleeve 560).

At 804, after the well tool 550 is transported to the wellbore 201 at 802, the outer radial surface of the well tool 550 is exposed by moving a rod (such as the rod 562) coupled to the sleeve 560.

At 806, an inner diameter of the well tool 550 (such as the inner liner diameter defined by the deformable liner 501) is increased. The inner diameter of the well tool 550 can be increased by inflating an inflatable packer of the well tool 550 (such as the first inflatable packer 503 positioned within the deformable liner 501), causing the deformable liner 501 to deform. The inner diameter of the well tool 550 can be increased to at least an outer diameter of the sleeve 560.

After the inner diameter of the well tool 550 is increased at 806, the deformable liner 501 can be secured within the wellbore 201 using another inflatable packer (such as the second inflatable packer 505 positioned around the deformable liner 501). At 808, the sleeve 560 is removed from the wellbore 201 through a region of the well tool 550 defined by the increased inner diameter of the well tool 550.

Example

A deformable liner made of 304L stainless steel had initial dimensions of 84 millimeters (mm) for outer diameter (OD) of 84 millimeters (mm), 2.00 mm for thickness, and 2.44 meters (m) for length. A first inflatable packer with initial dimension of 67 mm OD was used to deform the deformable liner. The first inflatable packer was rated for 6,000 pounds per square inch gauge (psig) and a maximum OD of 96 mm. The deformable liner was deformed and cemented within a test cell with a 155.6 mm inner diameter (ID) and 5,000 psig pressure rating. A high pressure water pump was used to inflate the first inflatable packer. A vacuum pump was used to provide vacuum within the second inflatable packer before the second inflatable packer was filled with cement. A cement pump was used to pump cement into the second inflatable packer. A 5 bar (72.5 psig) air accumulator was used to apply pressure to the cement pump and the second inflatable packer while the cement solidified within the second inflatable packer.

The first inflatable packer was positioned within the deformable liner, and this assembly of first inflatable packer and deformable liner was positioned within the test cell. The high pressure water pump supplied water to the first inflatable packer at 3,900 psig to inflate the first inflatable packer and expand the deformable liner. The assembly was removed from within the test cell, so that measurements could be made. The OD of the deformable liner was 95.5 mm after the first inflatable packer was inflated.

An end cap was welded to the deformable liner, then the second inflatable packer was positioned around the deformable liner. This assembly of second inflatable packer and deformable liner was positioned within the test cell. The cement pump and the vacuum pump were connected to the second inflatable packer. A vacuum was produced within the second inflatable packer using the vacuum pump. The 5 bar air accumulator was connected to the cement pump, and cement was pumped into the second inflatable packer using the cement pump. Filling the second inflatable packer with cement took approximately 25 minutes. The cement pump was disconnected, and the cement within the second inflatable packer was allowed to solidify under a pressure of 5 bar (supplied by the air accumulator) for approximately 70 hours.

Figure 9:
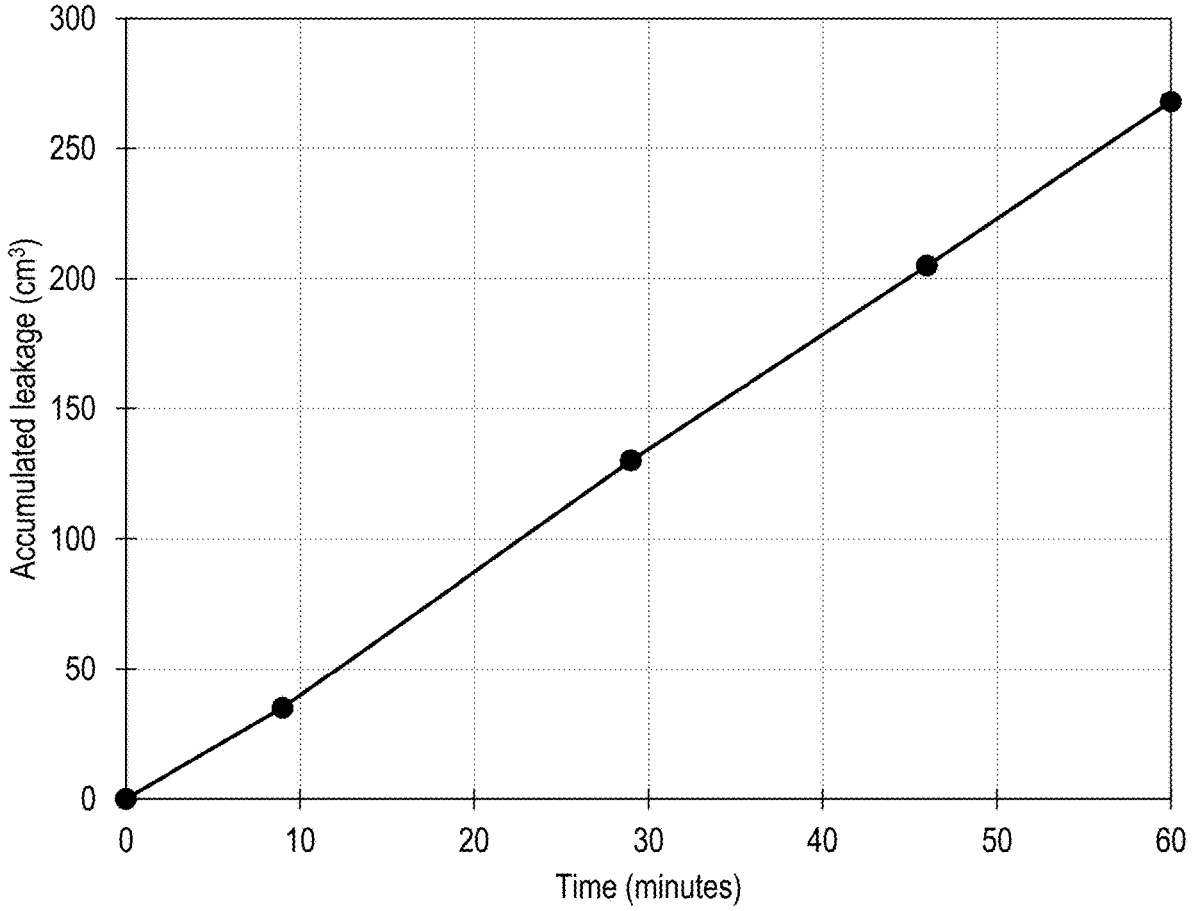
FIG. 9 is a plot of leakage vs. time from a leak test.

Calculations showed that approximately 25 liters (L) of cement slurry would be needed to fill the second inflatable packer, so a total amount of 40 L of cement slurry was prepared as a margin for injecting the cement slurry. The cement slurry was made up of a mixture of 38.5 kilograms (kg) of ScanCement Portland composite cement (HeidelbergCement Bangladesh Ltd.), 16.5 kg of Expancrete (Mapei), 15.8 kg of water, and 2.2 kg of Dynamon SX-N (Mapei). After solidifying the cement slurry within the second inflatable packer, the high pressure water pump was connected to the test cell to apply 500 pounds per square inch (psi) differential pressure for 1 hour, during which leakage rate was measured. A steady leakage rate of approximately 4.5 cubic centimeters per min ($cm^3$/min) was measured throughout the 1-hour test. The measured leakage vs. elapsed time is shown as a plot in FIG. 9.

In this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

In this disclosure, "approximately" means a deviation or allowance of up to 10 percent (%) and any variation from a mentioned value is within the tolerance limits of any machinery used to manufacture the part.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise. "About" can allow for a degree of variability in a value or range, for example, within 10%, within 5%, or within 1% of a stated value or of a stated limit of a range.

While this disclosure contains many specific implementation details, these should not be construed as limitations on the scope of the subject matter or on the scope of what may be claimed, but rather as descriptions of features that may be specific to particular implementations. Certain features that are described in this disclosure in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results.

Accordingly, the previously described example implementations do not define or constrain this disclosure. Other changes, substitutions, and alterations are also possible without departing from the spirit and scope of this disclosure.

What is claimed is:

1. A method comprising:

positioning a well tool within a wellbore, the well tool having an initial outer diameter before the well tool is positioned within the wellbore, the well tool comprising:

a deformable liner;

a first inflatable packer positioned within the deformable liner;

a second inflatable packer positioned around the deformable liner;

an inflation tool coupled to each of the first inflatable packer and the second inflatable packer, independently, the inflation tool configured to convey hydraulic pressure to inflate each of the first inflatable packer and the second inflatable packer, independently;

a tubular connection connecting the inflation tool to the second inflatable packer before the well tool is positioned within the wellbore, the tubular connection configured to allow fluid communication between the inflation tool and the second inflatable packer; and a backflow prevention device connected to the tubular connection, the backflow prevention device positioned closer to the second inflatable packer than to the inflation tool, the backflow prevention device configured to allow fluid to flow through the backflow prevention device from the inflation tool to the second inflatable packer and configured to prevent fluid from flowing through the backflow prevention device from the second inflatable packer to the inflation tool, wherein the tubular connection comprises an engineered weak point positioned along the tubular connection closer to the second inflatable packer than to the inflation tool, wherein the tubular connection is configured to break at the engineered weak point in response to an application of tension strain on the tubular connection;

inflating the first inflatable packer to deform the deformable liner, such that an inner liner diameter of the deformable liner, after the deformable liner is deformed, is equal to or greater than the initial outer diameter of the well tool; and inflating the second inflatable packer to sealably contact an inner wall of the wellbore.

2. The method of claim 1, further comprising, after inflating the first inflatable packer, removing the first inflatable packer from within the deformable liner.

3. The method of claim 1, wherein inflating the second inflatable packer comprises:

flowing a hardening fluid into the second inflatable packer; and allowing the hardening fluid to solidify within the second inflatable packer, such that the second inflatable packer remains permanently inflated.

4. The method of claim 1, further comprising, after inflating the second inflatable packer:

moving the inflation tool away from the second inflatable packer, such that the tubular connection breaks at the engineered weak point; and removing the inflation tool from within the wellbore.

5. The method of claim 1, wherein the deformable liner comprises:

a first slotted end; and a second slotted end opposite the first slotted end.

6. The method of claim 5, further comprising:

flaring the first slotted end radially outward; and flaring the second slotted end radially outward.

7. The method of claim 6, further comprising guiding a piece of equipment to the deformable liner with the flared first slotted end or the flared second slotted end.

8. The method of claim 1, wherein a ratio of the inner liner diameter after the deformable liner is deformed to the inner liner diameter before the deformable liner is deformed is in a range of approximately 1.02 to approximately 3.

9. A method comprising:

positioning, within a wellbore:

a deformable liner;

a first inflatable packer positioned within the deformable liner; and a second inflatable packer positioned around the deformable liner;

increasing an inner liner diameter of the deformable liner by inflating the first inflatable packer; and after increasing the inner liner diameter of the deformable liner, permanently securing the deformable liner within the wellbore by inflating the second inflatable packer.

10. The method of claim 9, wherein, before being positioned within the wellbore, the second inflatable packer defines an initial outer diameter, and increasing the inner liner diameter of the deformable liner comprises increasing the inner liner diameter of the deformable liner to at least equal to or greater than the initial outer diameter.

11. The method of claim 9, further comprising, after increasing the inner liner diameter of the deformable liner:

deflating the first inflatable packer; and removing the first inflatable packer from within the deformable liner.

12. The method of claim 9, wherein permanently securing the deformable liner within the wellbore comprises contacting the second inflatable packer to an inner wall of the wellbore.

13. The method of claim 12, wherein permanently securing the deformable liner within the wellbore comprises:

flowing a hardening fluid into the second inflatable packer; and allowing the hardening fluid to harden within the second inflatable packer.

14. A well tool comprising:

a deformable liner configured to be positioned within a wellbore, the deformable liner configured to be deformed radially;

a first inflatable packer configured to be positioned within the deformable liner, the first inflatable packer configured to be inflated while positioned within the deformable liner to deform the deformable liner radially;

a second inflatable packer configured to be positioned around the deformable liner, the second inflatable packer configured to be inflated to an inner wall of the wellbore;

an inflation tool fluidically coupled to each of the first inflatable packer and the second inflatable packer, independently, the inflation tool configured to convey hydraulic pressure to inflate each of the first inflatable packer and the second inflatable packer, independently;

a tubular connection connecting the inflation tool to the second inflatable packer before the well tool is positioned within the wellbore, the tubular connection configured to allow fluid communication between the inflation tool and the second inflatable packer;

a backflow prevention device connected to the tubular connection, the backflow prevention device positioned closer to the second inflatable packer than to the inflation tool, the backflow prevention device configured to allow fluid to flow through the backflow prevention device from the inflation tool to the second inflatable packer and configured to prevent fluid from flowing through the backflow prevention device from the second inflatable packer to the inflation tool, wherein the tubular connection comprises an engineered weak point positioned along the tubular connection closer to the second inflatable packer than to the inflation tool, wherein the tubular connection is configured to break at the engineered weak point in response to an application of tension strain on the tubular connection.

15. The well tool of claim 14, wherein the second inflatable packer, before being inflated, defines an initial outer diameter of the well tool, and the first inflatable packer is configured to be inflated while positioned within the deformable liner to deform the deformable liner radially, such that the deformable liner, after being deformed radially, defines an inner liner diameter that is greater than the initial outer diameter of the well tool.

16. The well tool of claim 14, wherein the deformable liner defines an inner liner diameter, and the deformable liner is configured to be deformed radially, such that a ratio of the inner liner diameter after being deformed radially to the inner liner diameter before being deformed radially is in a range of approximately 1.02 to approximately 3.

* * * * *